US011027166B1

(12) United States Patent
Francis

(10) Patent No.: US 11,027,166 B1
(45) Date of Patent: Jun. 8, 2021

(54) PORTABLE WEIGHT-BASED EXERCISE SYSTEM AND METHOD

(71) Applicant: Kenroy Anthony Francis, Ft. Lauderdale, FL (US)

(72) Inventor: Kenroy Anthony Francis, Ft. Lauderdale, FL (US)

( * ) Notice: Subject to any disclaimer, the term of this patent is extended or adjusted under 35 U.S.C. 154(b) by 0 days.

(21) Appl. No.: 16/139,234

(22) Filed: Sep. 24, 2018

Related U.S. Application Data

(60) Provisional application No. 62/608,113, filed on Dec. 20, 2017.

(51) Int. Cl.

| | |
|---|---|
| ***A63B 21/075*** | (2006.01) |
| ***A63B 21/072*** | (2006.01) |
| ***A63B 71/00*** | (2006.01) |
| ***A63B 21/00*** | (2006.01) |
| *A63B 21/02* | (2006.01) |
| *A63B 21/055* | (2006.01) |

(52) U.S. Cl.
CPC ..... *A63B 21/075* (2013.01); *A63B 21/00058* (2013.01); *A63B 21/0722* (2015.10); *A63B 71/0036* (2013.01); *A63B 21/00061* (2013.01); *A63B 21/00065* (2013.01); *A63B 21/02* (2013.01); *A63B 21/0552* (2013.01)

(58) Field of Classification Search
CPC ..... A63B 1/00; A63B 21/00047; A63B 21/00058; A63B 21/00061; A63B 21/00065; A63B 21/02; A63B 21/0552; A63B 21/0722; A63B 21/075; A63B 21/0036; A63B 21/06; A63B 21/072; A63B 21/0724; A63B 21/0726; A63B 2210/00; A63B 2210/50; A63B 2210/58
See application file for complete search history.

(56) References Cited

U.S. PATENT DOCUMENTS

| | | | | | |
|---|---|---|---|---|---|
| 5,997,442 | A * | 12/1999 | Cordes | A63B 21/0602 | 482/52 |
| 7,001,315 | B1 * | 2/2006 | Diodati | A63B 21/0552 | 482/104 |
| 7,458,920 | B2 * | 12/2008 | Hallar | A63B 21/06 | 482/104 |
| 8,550,243 | B2 * | 10/2013 | Moore | A45C 13/02 | 206/315.1 |
| 9,937,373 | B2 * | 4/2018 | Gvoich | A63B 21/072 | |

(Continued)

*Primary Examiner* — Megan Anderson
(74) *Attorney, Agent, or Firm* — John Rizvi; John Rizvi, P.A.—The Patent Professor

(57) ABSTRACT

A portable weight-based exercise system is disclosed that is capable of providing a user with a variety of weight-based exercise options. The exercise system includes a carrying case having a housing, containing dumbbells and a collection of weight disks for performing a variety of exercises, and a removable handle assembly for carrying or dragging the housing along the ground. First and second end bars and a center bar of the handle assembly are reconfigurable from a first configuration wherein they are disposed in a U-shaped arrangement to form the handle assembly to a second configuration wherein the first and second end bars are coaxial with the center bar to form a longer straight bar, which can then be combined with the dumbbells and collection of weight disks to form an assembled long weight bar. The housing may additionally include accessories such as a jump rope and an exercise band.

20 Claims, 22 Drawing Sheets

(56) References Cited

U.S. PATENT DOCUMENTS

| | | | | |
|---|---|---|---|---|
| 10,493,313 | B2 * | 12/2019 | Jones | A63B 21/0602 |
| 10,576,352 | B2 * | 3/2020 | Vester | A63B 21/4029 |
| 2008/0023355 | A1 * | 1/2008 | Reynolds | A63B 71/0036 206/315.1 |
| 2019/0240528 | A1 * | 8/2019 | Donnelly | A63B 71/0036 |
| 2020/0101344 | A1 * | 4/2020 | Jones | A63B 71/0036 |

* cited by examiner

PORTABLE WEIGHT-BASED EXERCISE SYSTEM AND METHOD

CROSS-REFERENCE TO RELATED APPLICATIONS

This application claims the benefit of U.S. Provisional Patent Application Ser. No. 62/608,113, filed on Dec. 20, 2017, which is incorporated by reference herein in its entirety.

FIELD OF THE INVENTION

The present invention relates generally to portable exercise systems, and more particularly, to a portable weight-based exercise system and method of operation.

BACKGROUND OF THE INVENTION

Many people participate in weight lifting or weight-based exercise to maintain health and improve body condition. Typically, the participants perform these exercises at local gyms or, if funds provide, at home user owned systems.

When exercising to maintain health or improve body function and condition, the exercises should be performed on a routine basis or regular schedule. This often becomes difficult if the participant is away from his local gym or home system. Travel for business and/or pleasure often interrupts the exercise schedule for sufficient periods of time to cause the participant to lose any progress being made.

While some weight sets are portable and may be taken along when traveling, they often cannot be used for carrying out a plurality of different exercise routines. Thus, the traveling user may find that exercising while traveling is incomplete or insufficient to meet their training needs. Should the user wish to broaden the scope of their exercising while traveling, the user may need to carry along several weight sets, which may be bulky and extremely heavy. In dependence of the means of transportation, it may be extremely costly, and even forbidden, to carry heavy weights.

Accordingly, there is an established need for a portable weight-based exercise system that solves at least one of the aforementioned problems. For example, there remains a need for a portable weight-based exercise system that allows a participant or user to perform various types of weight-based exercises while travelling. It is desirable that such a portable weight-based exercise system is also compact and easy to transport and store.

SUMMARY OF THE INVENTION

The present invention is directed to a convenient and portable weight-based exercise system that is capable of providing a user with a variety of weight-based exercise options. The exercise system includes a carrying case having a housing, containing weight training components such as dumbbells and a collection of weight disks for performing a variety of exercises, and a handle assembly for carrying or dragging the housing along the ground. The housing may be provided with wheel assemblies to allow the exercise system to be rolled along the ground by a user. The handle assembly is removable from the housing and includes a center bar and first and second end bars. The first and second end bars and the center bar are reconfigurable from a first configuration in which the first and second end bars are perpendicular to the center bar to form a U-shaped arrangement providing the handle assembly for moving the housing, to a second configuration in which the first and second end bars are coaxial with the center bar to form a longer straight bar. The straight bar can then be combined with the dumbbells and collection of weight disks to form an assembled long weight bar for performing other exercises. The housing may additionally include a jump rope, an exercise band, a hand exerciser and/or an electrical system for charging personal electronic devices and playing back music or instructional material during the exercise routines.

In a first implementation of the invention, a portable weight-based exercise system comprises a carrying case and a plurality of weight training components removably mounted within the housing. The carrying case comprises a housing and a handle assembly. The handle assembly includes a center bar and first and second end bars and is configured to selectively and reversibly adopt a mounted configuration and an exercising configuration. In the mounting configuration, first ends of the first and second end bars are removably mounted within the housing and second ends of the first and second end bars are removably connected to the center bar, and the center bar provides a gripping area to assist a user in transporting the portable weight-based exercise system. In the exercising configuration, the handle assembly is detached from the housing and usable as a lifting weight.

In a second aspect, the plurality of weight training components can include at least one dumbbell having at least one weight disk. In some embodiments, the at least one weight disk can include at least one heavyweight disk and at least one lightweight disk. Each of the at least one heavyweight disk and the at least one lightweight disk can be removably mountable on the at least one dumbbell.

In another aspect, at least one of the first and second end bars can extend through a through bore formed through a central shaft of the at least one dumbbell when the handle assembly is arranged in the mounted configuration.

In another aspect, the at least one dumbbell can include first and second dumbbells.

In another aspect, the first and second end bars can extend perpendicularly from the center bar when the handle assembly is arranged in the mounted configuration.

In another aspect, when the handle assembly is in the exercising configuration, the first and second end bars can be removably mounted to the center bar coaxially with the center bar.

In another aspect, the plurality of weight training components can include first and second dumbbells each carrying a respective at least one weight disk, and the first and second dumbbells can be removably mounted to the first and second end bars when the handle assembly is in the exercising configuration.

In another aspect, the first and second dumbbells can be removably mounted to the first and second end bars when the handle assembly is in the exercising configuration such that the first and second dumbbells, first and second end bars and center bar are coaxially arranged forming a straight bar.

In another aspect, in the exercising configuration of the handle assembly, inner ends of the first and second end bars can be mounted on opposite ends of the center bar and the first and second dumbbells can be mounted on opposite outer ends of the first and second end bars, respectively. In turn, the respective at least one weight disk can be removably carried by each one of the first and second dumbbells.

In another aspect, the portable weight-based exercise system can further include a pair of U-shaped spring clips securing the first and second end bars to the center bar in the exercising configuration of the handle assembly.

In another aspect, the portable weight-based exercise system can further include at least one insert in the housing. The plurality of weight training components can be removably placed in the at least one insert.

In another aspect, the portable weight-based exercise system can further include at least one movable panel on the housing to facilitate access to the plurality of weight components within the housing.

In another aspect, the portable weight-based exercise system can further include a charging port for charging and connecting an electronic device, and a speaker carried by the housing for playing back electronic audio files from the electronic device.

In another aspect, the plurality of training components can comprise at least one of a jump rope, an exercise band and a hand exerciser.

In another aspect, the portable weight-based exercise system can further include at least one wheel assembly carried by and providing rolling mobility to the housing.

In another aspect, the portable weight-based exercise system can further include a plurality of stand-offs carried by the housing and configured to support the housing on a floor or other flat surface such that the housing is elevated from the floor or other flat surface.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and portable weight-based exercise system that includes modular components which can be assembled in various configurations to perform a variety of different exercise routines.

Figure 1:
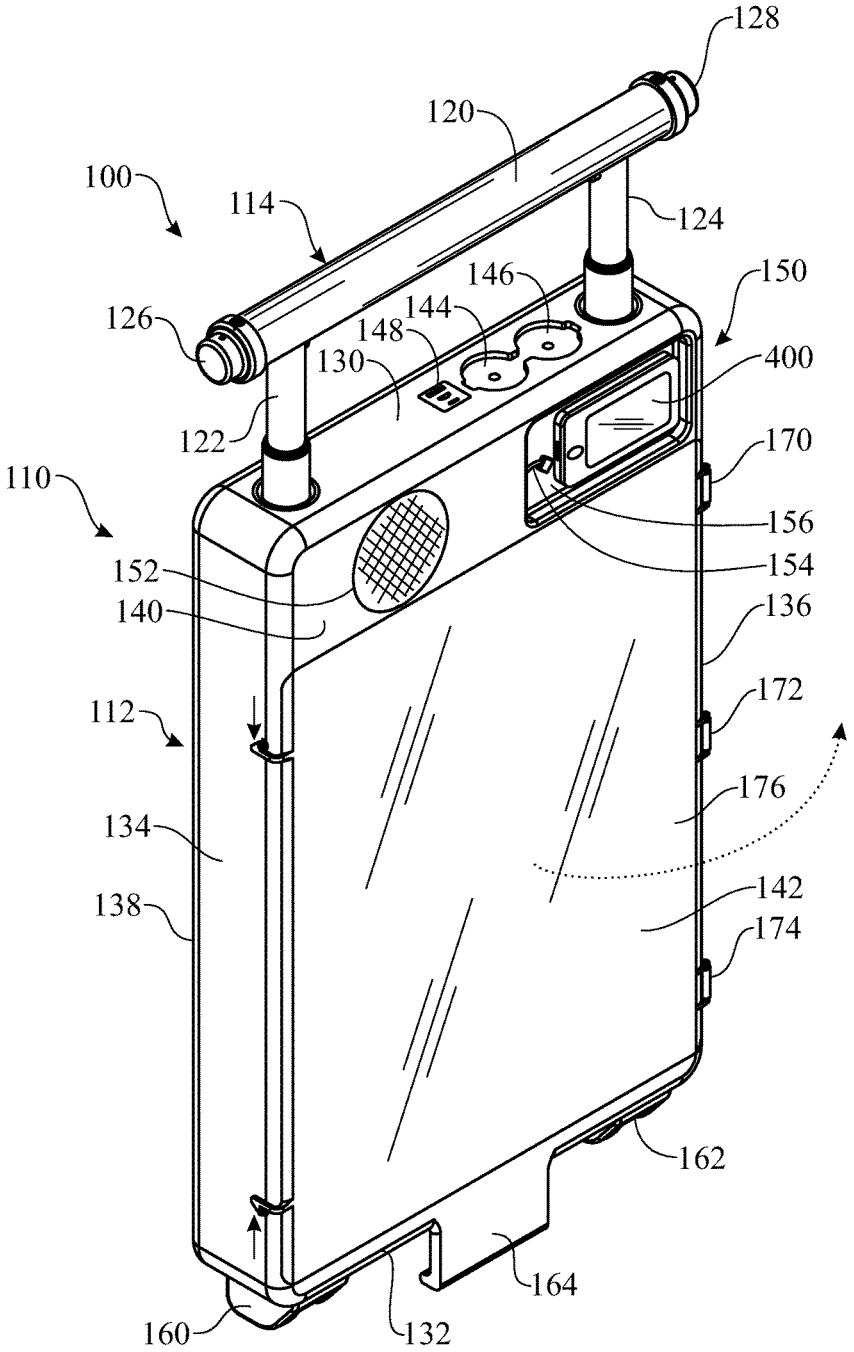
FIG. 1 presents a top front isometric view of a portable weight-based exercise system in accordance with an illustrative embodiment of the present invention, the movable lower front panel shown closed.
Figure 2:
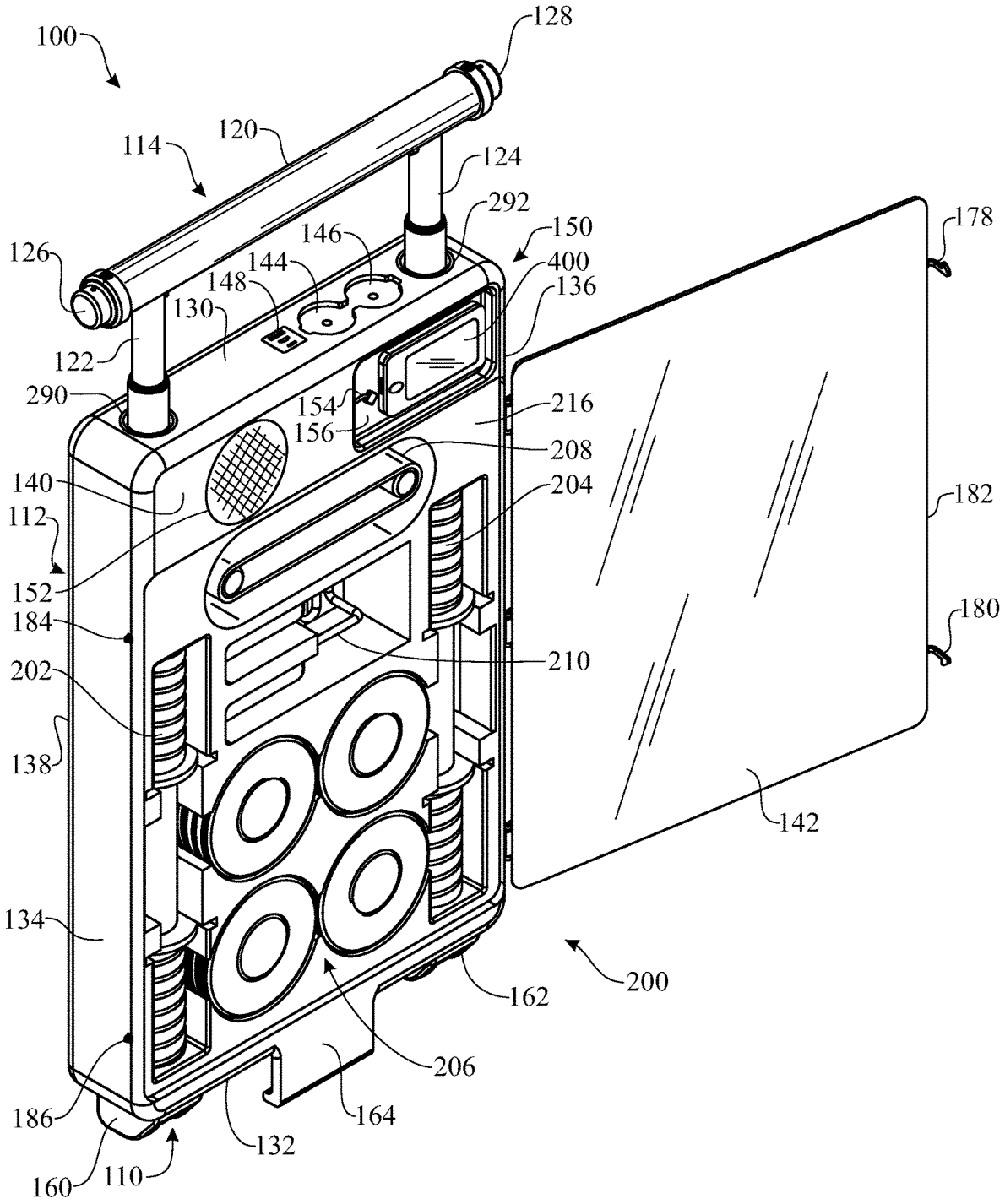
FIG. 2 presents a top front isometric view of the portable weight-based exercise system of FIG. 1 with the movable lower front panel shown open to reveal internal components.

Referring initially to FIGS. 1 and 2, a portable weight-based exercise system 100 is illustrated in accordance with an exemplary embodiment of the present invention, configured as a modular exercise system. As shown, the exercise system 100 generally includes a carrying case 110 having a housing 112 for retaining a variety of exercise components and a handle assembly 114 removably mounted to the housing 112 to facilitate transporting the exercise system 100. The removable handle assembly 114 additionally provides modular component parts of the exercise system and includes a top, center bar 120 and first and second end bars 122 and 124 extending downward and perpendicularly from the center bar 120. The first and second end bars 122 and 124 extend into and are removably mounted within the housing 112. First and second caps 126 and 128 are provided to secure the first and second end bars 122 and 124 to the center bar 120 as described below.

The housing 112 generally includes a top panel 130, a bottom panel 132, first and second side panels 134 and 136 and a back panel 138. The top panel 130, the bottom panel 132, the first and second side panels 134 and 136 as well as the back panel 138 are fixed to each other and may be integrally formed or assembled from separate parts and secured together using known methods such as, for example, welding, fusing, gluing, etc. The housing 112 additionally includes a fixed upper front panel 140 and a movable lower front panel 142. The upper front panel 140 is affixed to the top panel 130 and the first and second side panels 134 and 136. The lower front panel 142 is movably mounted to the first side panel 134 in order to access weight training components contained within the housing 112. The top panel 130 includes a pair of recesses 144 and 146 for receipt of the end caps 126 and 128 when not needed. The top panel additionally includes a charging port or plug receptacle 148 to charge an internal battery system (not shown) for powering and/or charging various associated or auxiliary devices.

The housing 112 may be formed from a variety of materials, such as, but not limited to, metallic materials (e.g., stainless steel), polymeric materials, carbon fiber materials, combinations thereof, etc. The handle assembly 114 may also be formed from similar materials. In one embodiment, the housing 112 is formed from an ABS plastic to reduce weight while maintaining sufficient strength to safely retain the internal components discussed hereinbelow. In a specific embodiment, the movable lower front panel 142 may be formed from a transparent material, such as, but not limited to, polycarbonate, to allow a user to view the internal components contained within the housing 112. The handle assembly 114, including the center bar 120 and the first and second end bars 122 and 124, is formed of a material with sufficient strength to support added weights during exercise routines. For example, the center bar 120 and first and second end bars 122 and 124 can be formed from stainless steel.

Figure 3:
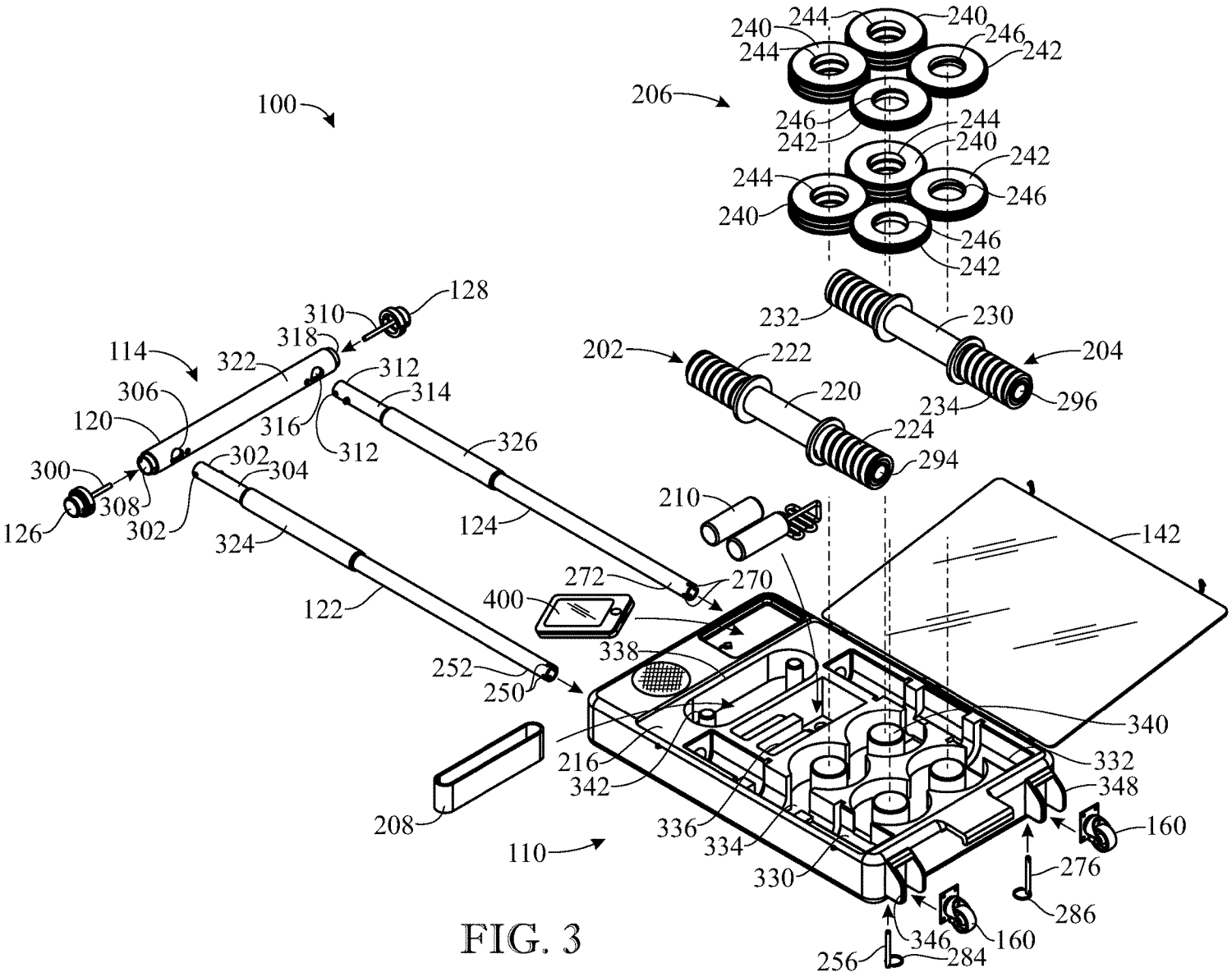
FIG. 3 presents an exploded, isometric view of the portable weight-based exercise system of FIG. 1.

As noted above, the exercise system 100 of the present embodiment includes an electrical or internal battery system (not shown) to power various devices. The exercise system 100 and more particularly, the housing 112, has an entertainment system 150 incorporated into the upper front panel 140, which includes a speaker 152 positioned in the upper front panel 140. A charging port or connection cable 154 extends from the upper front panel 140 and is connected to the battery system for attachment to a user provided external electronic device 400 such as, but not limited to, a cellphone (as shown in FIG. 3), a tablet, an MP3 player, or similar portable device capable of containing various sounds such as, for example, music, verbal exercise routine instructions, etc. for play back through the speaker 152. A recess 156 is formed within the upper front panel 140 for retaining the electronic device 400 during charging, while connecting the electronic device 400 for playing sound or simply while transporting the electronic device 400 in the exercise system 100 when the lower front panel 142 is closed.

In order to easily move or transport the exercise system 100 during travel, two or more wheel assemblies 160 and 162 are affixed to the bottom panel 132 providing rolling mobility to the exercise system 100. A stand 164 is incorporated into the bottom panel 132 to maintain the exercise system 100 in an upright position while stationary.

As noted hereinabove, the lower front panel 142 is movably mounted to the remainder of the housing 112. The lower front panel 142 is movable between a closed position securing components within the housing (FIG. 1) and an open position allowing access to components contained within the housing 112 (FIG. 2). As best shown in FIG. 1, a plurality of hinges 170, 172 and 174 pivotally connect a second side edge 176 of the lower front panel 142 to the second side panel 136. As best shown in FIG. 2, a pair of locking hooks 178 and 180 are incorporated into a first side edge 182 of the lower front panel 142 and engage recesses 184 and 186, respectively, formed in the first side panel 134 to maintain the lower front panel 142 in the closed position as shown in FIG. 1.

Referring now to FIGS. 2 and 3, the portable weight-based exercise system 100 includes a variety of removable exercise components 200 for performing a variety of exercises. These exercise components 200 are retained within receptacles or compartments formed in the housing 112. The exercise components 200 generally include a pair of dumbbells 202 and 204 and a collection of weights 206 for use with the dumbbells 202 and 204 to perform a variety of weight-based exercises. The exercise components may additionally include an elastic exercise band 208 for performing a variety of resistance training exercises and a jump rope 210 for cardiovascular exercise.

As further shown in FIG. 2, the carrying case 110 can include an insert 216 positioned within the housing 112 and comprising cavities suitably shaped and sized to snugly receive the exercise components 200. The insert 216 prevents the exercise components 200 from shifting during transport as well as preventing the exercise components 200 from damaging each other. In some embodiments, the insert 216 can be formed from a foam material.

Referring now specifically to FIG. 3, dumbbell 202 generally includes a center shaft or bar 220 having a pair of rotatable handles 222 and 224 mounted thereon. Likewise, dumbbell 204 also includes a center shaft or bar 230 having a pair of rotatable handles 232 and 234. The rotatable handles 222, 224 and 232, 234 of the dumbbells 202 and 204, respectively, are provided to retain weights from the collection of weights 206 as described in detail hereinbelow. The bars 220 and 230 allow the dumbbells 202 and 204 to be grasped by a user to perform exercises. The rotatable mounting of the handles 222, 224 on the bar 220 of the dumbbell 202 and the handles 232, 234 on the bar 230 of the dumbbell 204 allow the dumbbells 202 and 204 to be rolled along the ground while weights are mounted thereon in order to perform other specific exercises by a user.

In some embodiments, the collection of weights 206 can include multiple heavyweight disks 240 and multiple lightweight disks 242. By combining one or more of the heavyweight and/or lightweight disks 240, 242 on one of the dumbbells 202 and/or 204, a user can configure the weight of the individual dumbbell to a desired weight to perform the exercises. For instance, each heavyweight disk 240 can have an individual weight of 5 lbs. and each of the lightweight disks 242 can have an individual weight of 2.5 lbs. In order to mount the heavyweight disks 240 on one of the dumbbells 202 or 204, the heavyweight disks 240 have center holes 244. Likewise, the lightweight disks 242 have center holes 246 to mount the lightweight disks 242 on the dumbbells 202 and 204.

Figure 8:
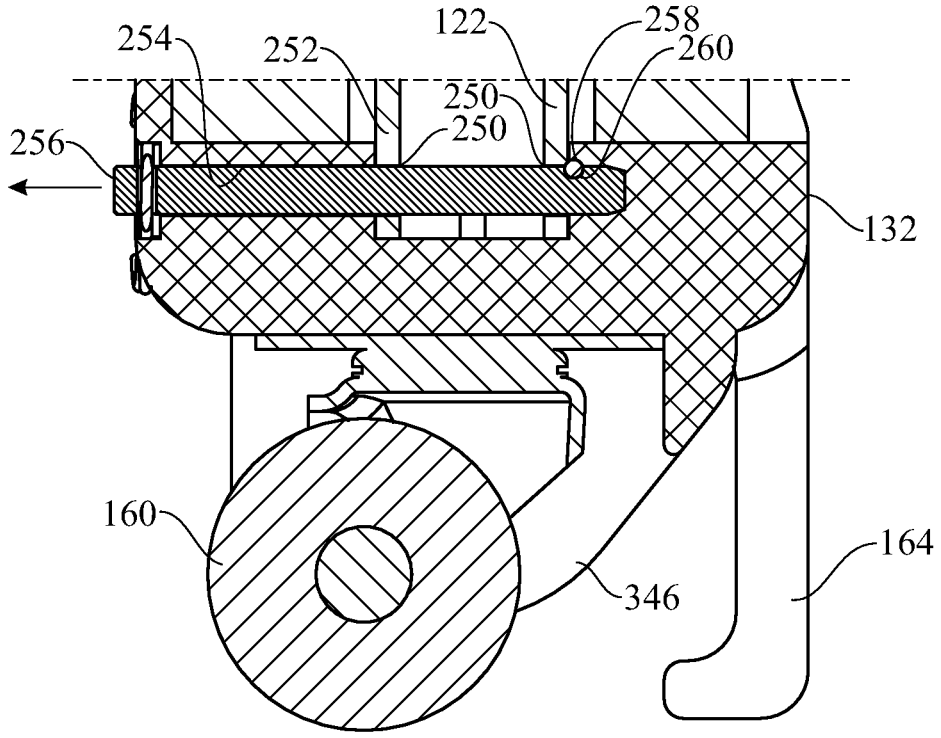
FIG. 8 presents a partial, cross-sectional side elevation view of a bottom area of the portable weight-based exercise system of FIG. 1, illustrating further connecting components.
Figure 9:
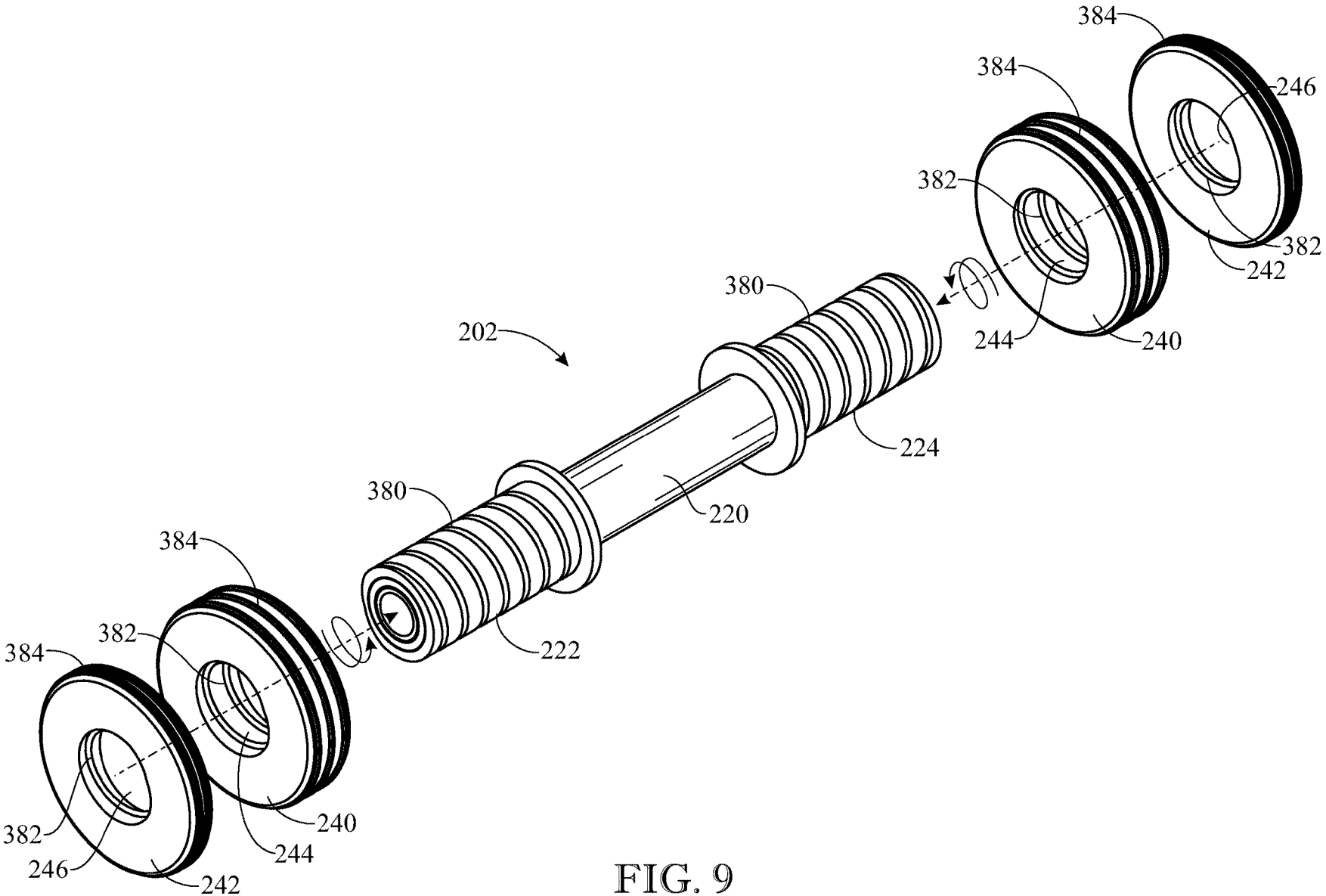
FIG. 9 presents an isometric view of a dumbbell bar and weights of the portable weight-based exercise system of the present invention prior to assembly.

As noted above, the exercise system 100 includes modular components to perform a variety of exercises. The handle assembly 114 can be disassembled from the housing 112 and separated into its components, namely the center bar 120 and the first and second end bars 122 and 124, respectively. With reference to FIGS. 3 and 8, a pair of pass through holes 250 are provided in a first end 252 of the first end bar 122 and the housing includes a bore 254 extending transversely into the bottom panel 132. A first retaining pin 256 is provided and passes through the bore 254 in the bottom panel 132 and the pass through holes 250 in the first end bar 122 to retain the first end bar 122 in the housing 112. A detent ball 258 in the bore 254 engages a notch 260 in the first retaining pin 256 to secure the first retaining pin 256 in the bore 254. Similarly, a pair of pass through holes 270 are provided in a first end 272 of the second end bar 124 and the housing includes an additional bore (not shown, but otherwise similar to bore 254) extending transversely into the bottom panel 132. A second retaining pin 276 passes through the holes 270 and the additional bore to retain the second end bar 124 within the housing 112. While not specifically shown, a detent ball (similar to detent ball 258) engages a notch 280 in the second retaining pin 276 to secure the second retaining pin within the housing 112.

In order to disassemble the handle assembly 114 from the housing 112, pull rings 284 and 286 on the first and second retaining pins 256 and 276, respectively, are grasped and the first and second retaining pins 256 and 276 are pulled out of the bore 254 and the additional bore in the bottom panel 132. This frees up the first and second end bars 122 and 124, respectively, from the housing 112 and the entire handle assembly 114 can be removed from the housing 112.

Figure 4:
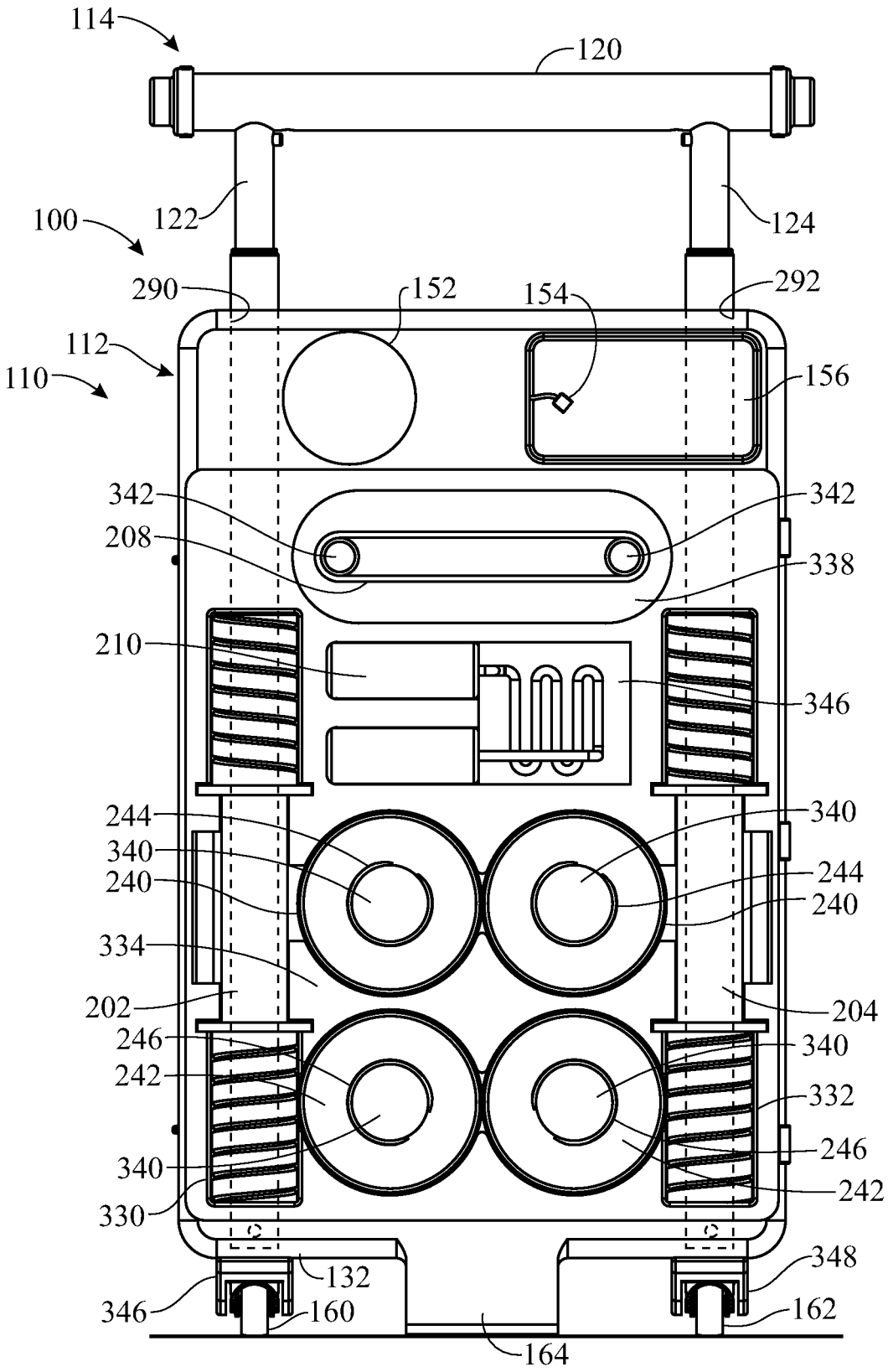
FIG. 4 presents a front elevation view of the portable weight-based exercise system of FIG. 1, with portions of end bars of a handle assembly shown in phantom and extending through respective dumbbells and a carrying case of the portable weight-based exercise system.

Referring for the moment to FIGS. 2 and 4, it should be noted that, in the assembled condition, the first and second end bars 122 and 124 pass through upper openings 290 and 292 in the top panel 130 of the housing 112 and pass through the insert 216 to the bottom panel 132 where they are secured by the first and second retaining pins 256 and 276. When the first and second dumbbells 202 and 204 are present in the insert 216, the first end bar 122 passes through a through bore 294 extending longitudinally through the first dumbbell 202 and the second end bar 124 passes through a through bore 296 extending longitudinally through the second dumbbell 204. This not only contributes to a compact size of the exercise system 100 but also assists in keeping the first and second dumbbells 202 and 204 in position within the housing 112 during transportation.

Figure 6:
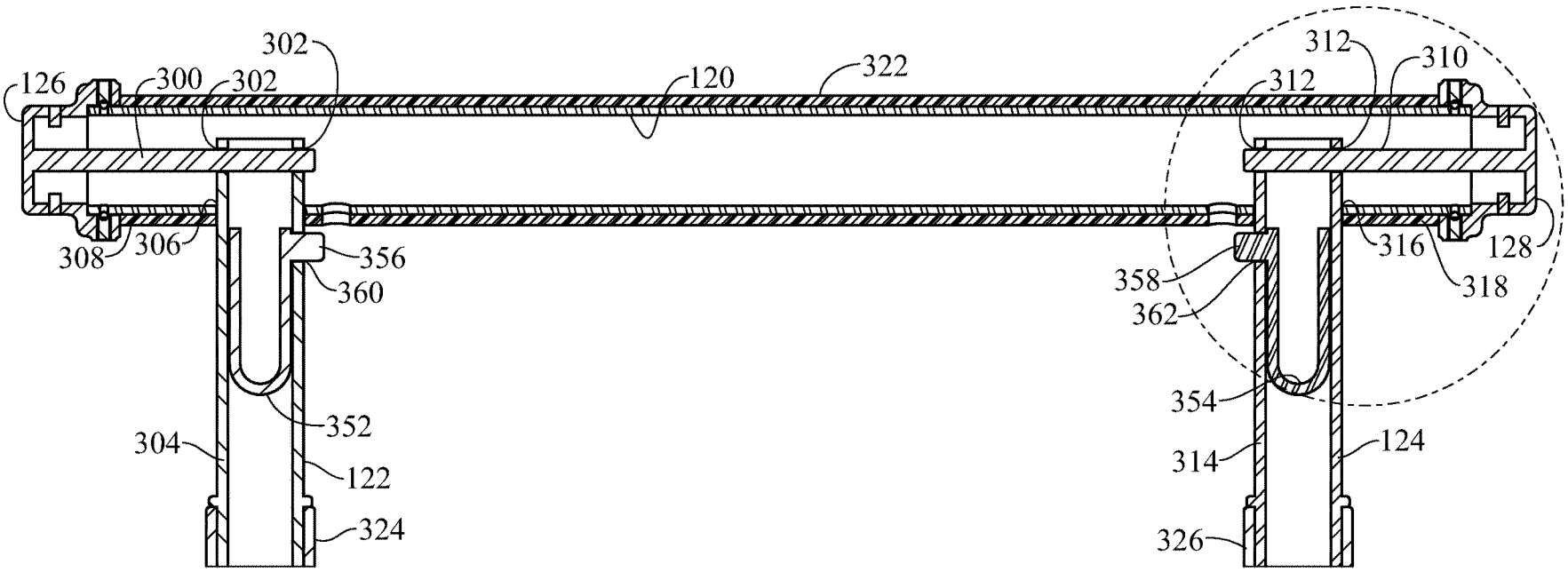
FIG. 6 presents a cross-sectional front elevation view of the handle assembly of the portable weight-based exercise system of FIG. 1.

Referring now to FIGS. 3 and 6, once the handle assembly 114 has been removed from the housing 112, the handle assembly 114 may be disassembled into its component parts. As noted above, the end caps 126 and 128 secure the first and second end bars 122 and 124, respectively, to the center bar 120. The end cap 126 includes a pin 300 which passes through holes 302 in a second end 304 of the first end bar 122 to secure the first end bar 122 to the center bar 120. The second end 304 of the first end bar 122 passes through a hole 306 in a first end 308 of the center bar 120. Likewise, the end cap 128 includes a pin 310 which passes through holes 312 in a second end 314 of the second end bar 124 to secure the second end bar 124 within the center bar 120. Specifically, the second end 314 of the second end bar 124 passes through a hole 316 in a second end 318 of the center bar 120.

To disassemble the first and second end bars 122 and 124 from the center bar 120, the end caps 126 and 128 are removed pulling the respective pins 300 and 310 out of the first and second end bars 122 and 124. Thereafter, the first and second end bars 122 and 124 can be pulled out of the holes 306 and 316 in the center bar 120 to free the three components, i.e., the center bar 120, first end bar 122 and the second end bar 124 from each other for further use in the exercise system. In some embodiments, as shown in FIG. 3, the center bar 120 can include a foam covering 322 and the first and second end bars 122 and 124 can also include foam coverings 324 and 326, respectively, to increase the comfort of the user and provide a positive gripping surface during exercises described hereinbelow.

With reference to FIGS. 3 and 4, the insert 216 includes receptacles or cutouts for the various components supported therein. For example, first and second cutouts 330 and 332 to accommodate the first and second dumbbells 202 and 204, a third cutout 334 to accommodate the collection of weights 206, a fourth cutout 336 to accommodate the jump rope 210 and a fifth cutout 338 to accommodate the exercise band 208. The third cutout 334 includes posts 340 to engage the holes 244 and 246 in the heavyweight and lightweight disks 240 and 242 and the fourth cutout 336 includes posts 342 to secure the exercise band 208 therearound.

Figure 5:
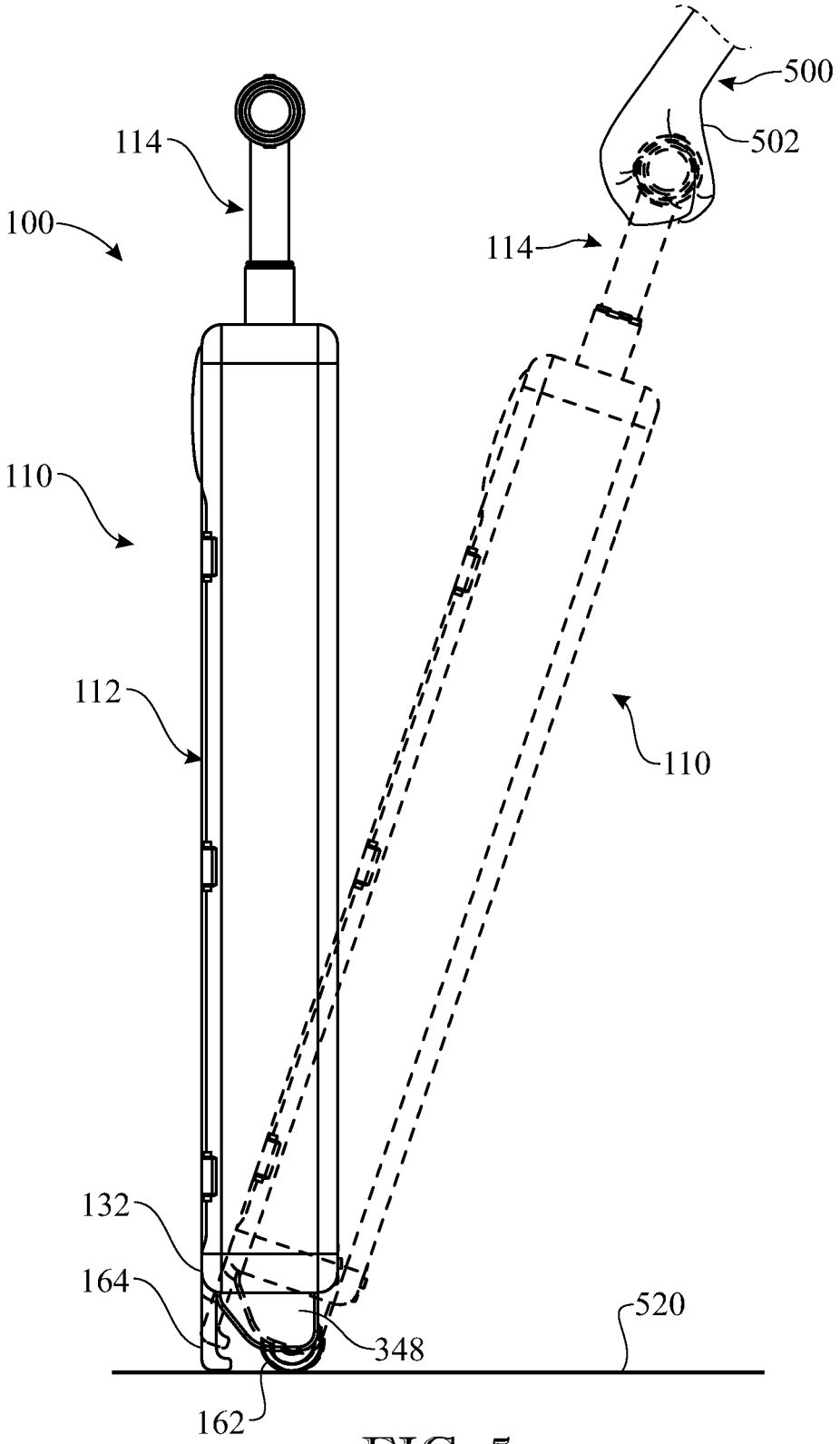
FIG. 5 presents a side elevation view of the portable weight-based exercise system of FIG. 1, shown in a rest position (solid lines) and a rolling position (phantom lines)

Referring for the moment to FIGS. 3, 4, 5 and 8, the wheel assemblies 160 and 162 are affixed to the bottom panel 132 to allow the carrying case 110 to be rolled rather than just carried due to the weight of the collection of weights 206 and other components. Specifically, the wheel assembly 160 is connected to a bracket 346 extending from the bottom panel 132 and the wheel assembly 162 is connected to a bracket 348 also extending from the bottom panel 132. As best shown in FIG. 5, in an upright and stationary position, the carrying case 110 rests on the wheel assemblies 160 and 162 and on the stand 164. To move the carrying case 110, the handle assembly 114 is grasped by a hand 502 of a user 500 and tilted rearward off the stand 164, so that the carrying case 110 is supported only on the wheel assemblies 160 and 162 and thus provided with rolling mobility by which the exercise system 100 can be pulled or rolled along a floor 520 by the user 500.

Figure 7:
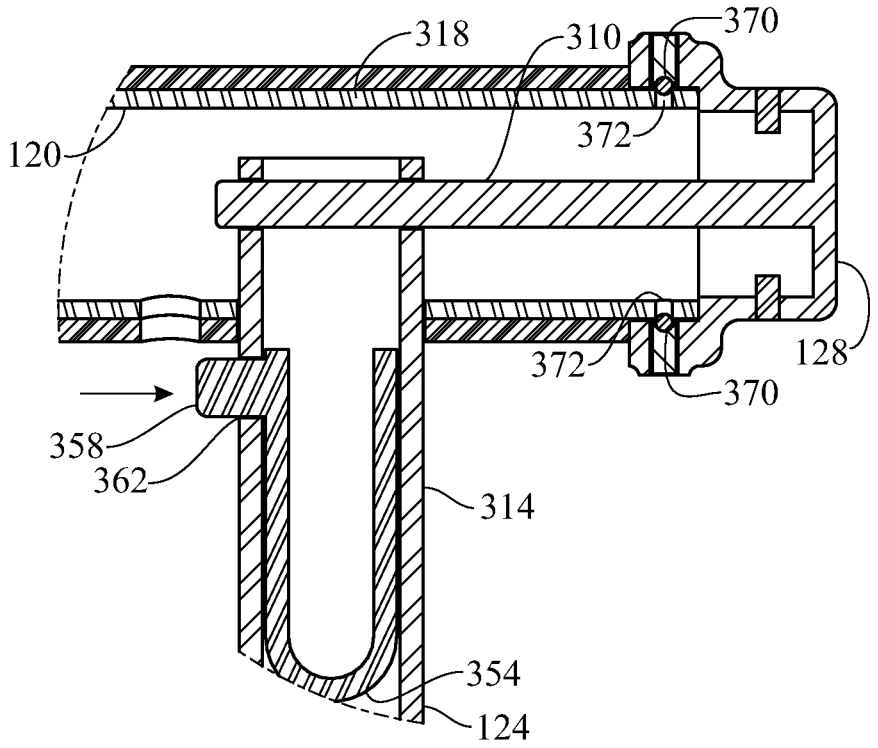
FIG. 7 presents an enlarged area of detail view of FIG. 6 illustrating connecting components of the handle assembly.
Figure 12:
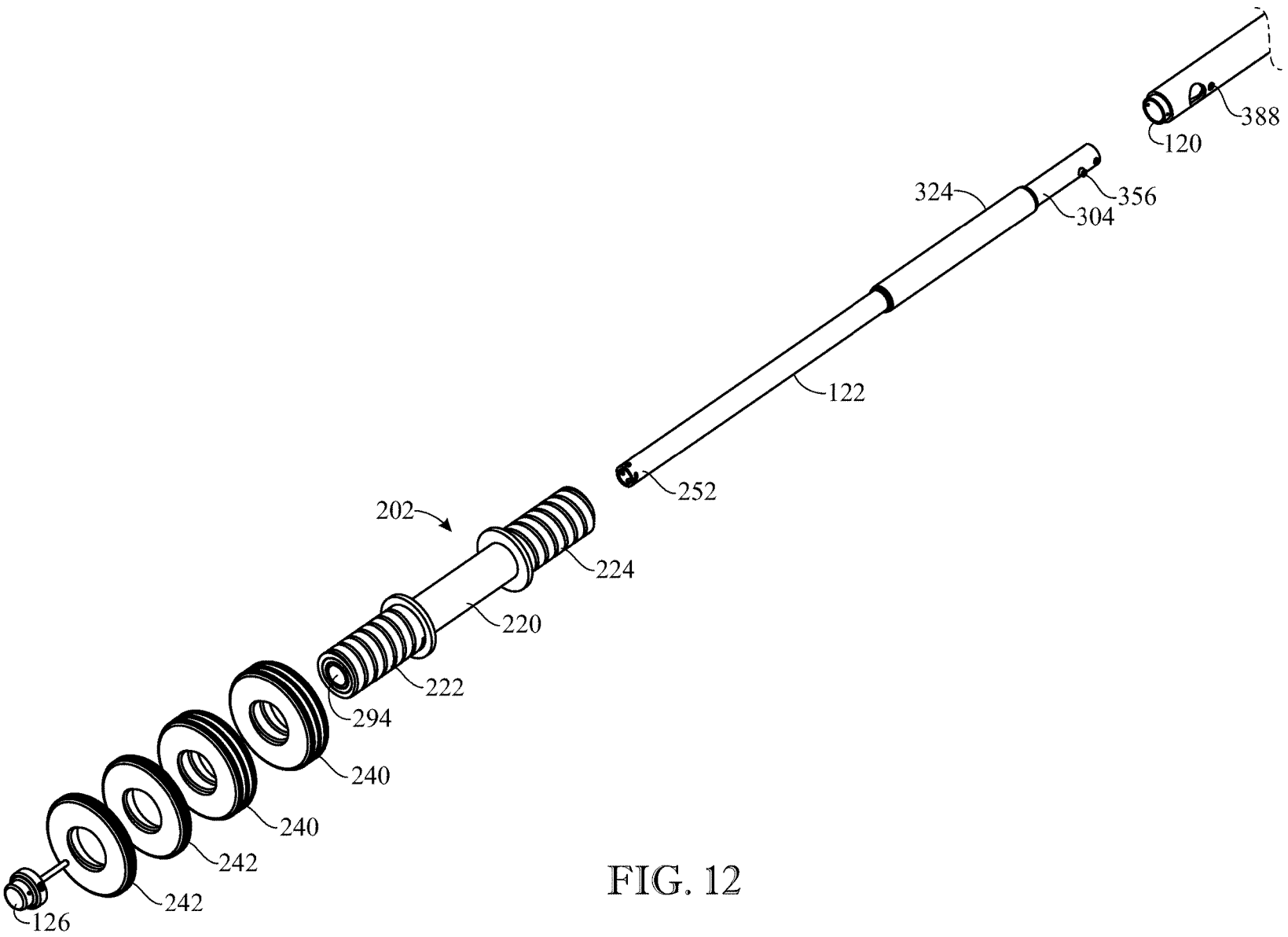
FIG. 12 presents an exploded, partial isometric view of the handle assembly, dumbbell and weights components prior to assembly into a long bar weight system.
Figure 13:
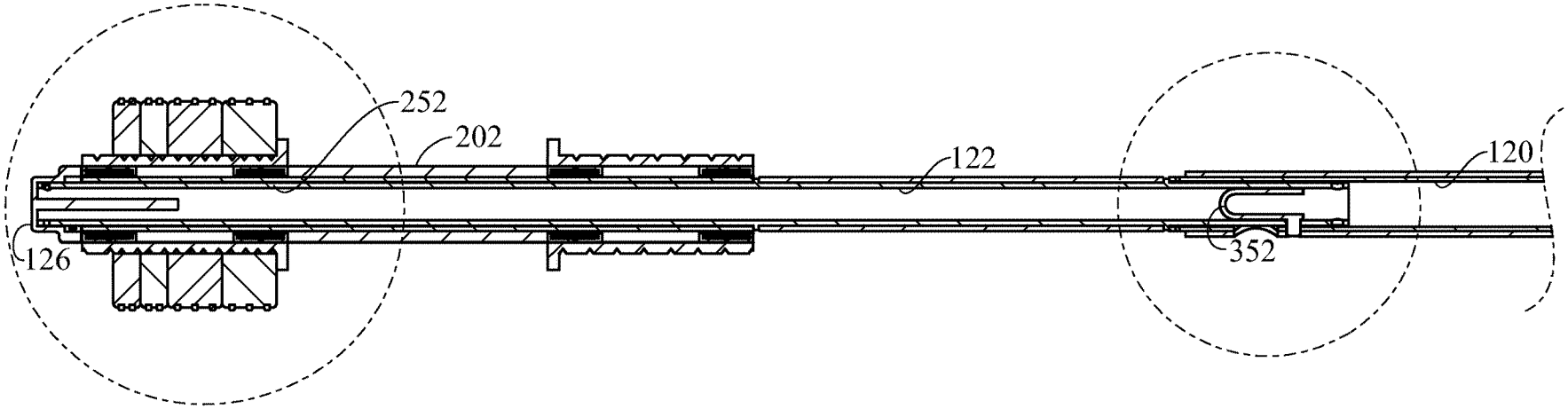
FIG. 13 presents a partial, cross-sectional front elevation view of the long bar weight system.

Referring to FIGS. 6 and 7 and as mentioned heretofore, the U-shaped handle assembly 114 can be disassembled into its component parts including the center bar 120 and the first and second end bars 122 and 124. Once the center bar 120 and the first and second end bars 122 and 124 have been disassembled from their initial U-shaped arrangement, the center bar 120 and the first and second end bars 122 and 124 can then be reassembled coaxially into a single straight bar 350 (FIGS. 12 and 13) as described in more detail hereinbelow. U-shaped spring clips 352 and 354 are provided within the first and second end bars 122 and 124 for this purpose. The spring clips 352 and 354 have respective buttons 356 and 358 which, in the stored position, engage and are retained by holes 360 and 362 formed in the second ends 304 and 314 of the first and second end bars 122 and 124, respectively. As specifically shown in FIG. 7, the end cap 128 is retained on the center bar 120 by detent balls 370 which engage notches 372 in the second end 318 of the center bar 120. While not specifically shown, the end cap 126 is retained within the first end 308 of the center bar 120 by detent balls (similar to detent balls 370) which releasably engage (similar to notches 372) notches in the first end 308 of the center bar 120.

Referring now to FIGS. 1-3, 9-11 and 15, the use of the exercise system 100 and, in particular, the dumbbells 202 and 204 to perform a variety of exercises will now be described. Initially, all the exercise components are contained within the carrying case 110 (FIG. 2) of the exercise system 100 and the lower front panel 142 is in the closed condition against the remainder of the housing 112, as shown in FIG. 1. The user 500 moves the lower front panel 142 to the open condition (FIG. 2) and removes the first and second dumbbells 202 and 204 along with the collection of weights 206 (FIG. 3). With specific reference to FIG. 9, the rotatable handles 222, 224 and 232, 234 of the dumbbells 202 and 204, respectively, are preferably provided with handle threads 380 and the heavyweight and lightweight disks 240 and 242 are also provided with corresponding weight threads 382 in the center holes 244 and 246 of the heavyweight and lightweight disks, respectively. The dumbbells 202 and 204 are assembled by threading the desired heavyweight and/or lightweight disks 240 and 242 onto the rotatable handles, for example the rotatable handles 222 and 224 of the dumbbell 202, to prepare the dumbbells 202 and 204 for use.

Figure 10:
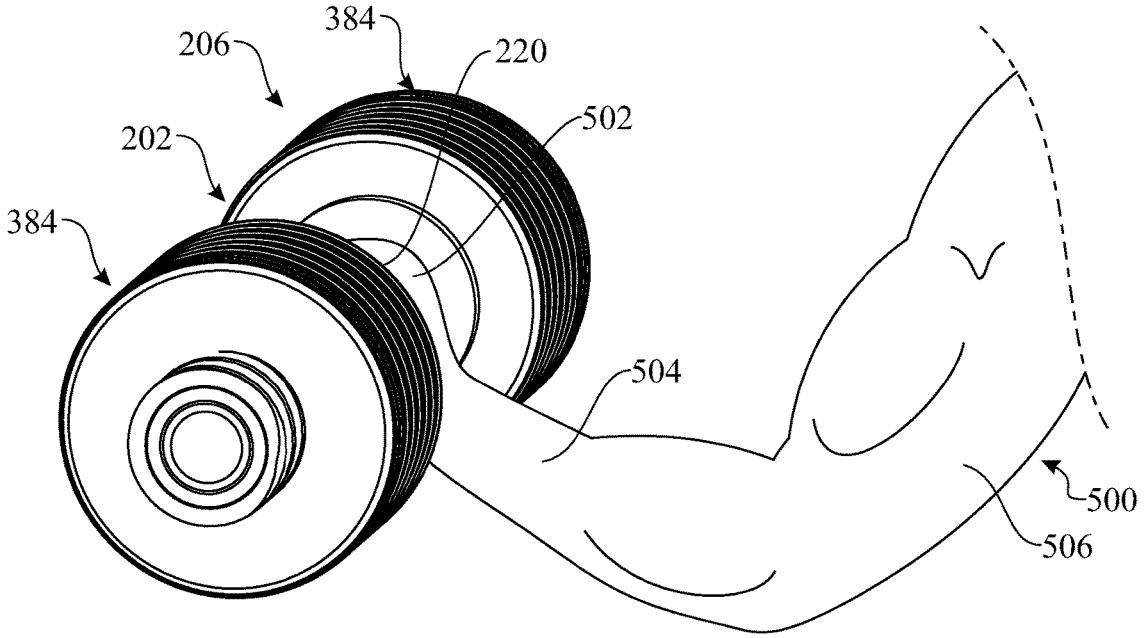
FIG. 10 presents a perspective view of the assembled dumbbell bar and weights in use to perform a first exercise.

Referring to FIG. 10, once the dumbbells 202 and/or 204 have been assembled with the desired amount of weight from the heavyweight and/or lightweight disks 240 and 242, the user 500 can perform arm curls type weight lifting exercises by grasping the bar of the dumbbell, for example the bar 220 of the dumbbell 202, with the user's hand 502, and lifting the combined dumbbell 202 and attached heavy and/or lightweight disks 240, 242 by bending the user's forearm 504 relative to the user's upper arm 506.

Figure 11:
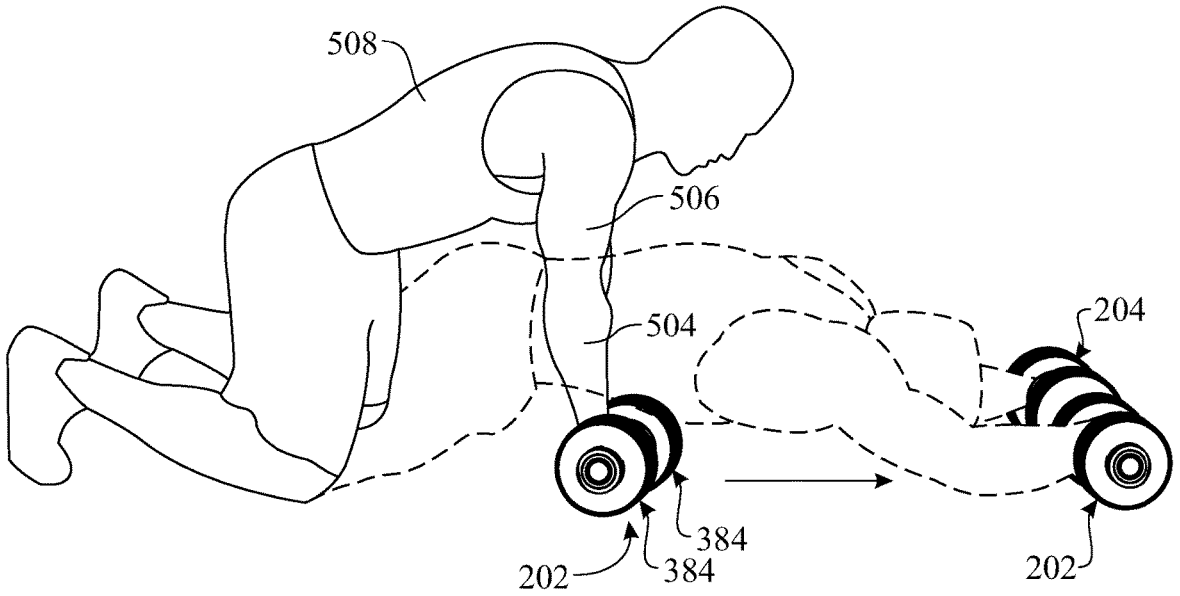
FIG. 11 presents another perspective view of the assembled dumbbell bar and weights in use to perform a second exercise.
Figure 15:
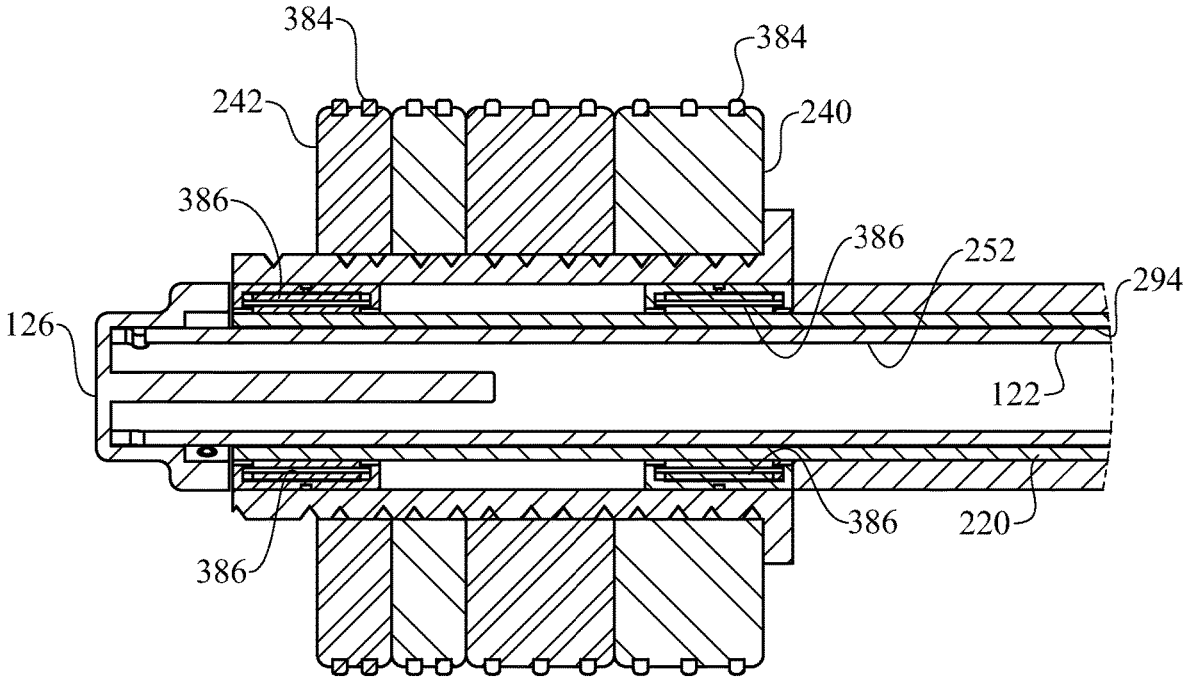
FIG. 15 presents an additional enlarged area of detail view of FIG. 13 illustrating weight assembly components and a bearing system of the dumbbell bar.

Referring now to FIGS. 11 and 15, should the user 500 desire to perform another type of exercise where the user 500 rolls both dumbbells 202 and 204 along the ground 520, both dumbbells 202 and 204 are grasped by the user's hands 502 and, with the forearm 504 and upper arm 506 straight, the user 500 extends and retracts his upper body 508 while rolling the dumbbells 502 and 504 along the floor or ground 520. In order to prevent the dumbbells 202 and 204 from slipping along the ground 520, rubber sleeves or rings 384 can be affixed around the heavyweight and lightweight disks 240 and 242 (See also FIG. 9). Further, as specifically shown in FIG. 15, bearings 386 can be provided within the rotatable handles 222, 224 of the dumbbell 202 and while not specifically shown, within the rotatable handles 232 and 234 of the dumbbell 204. The bearings 386 allow the rotatable handles 222, 224 of the dumbbell 202 to rotate relative to the bar 220 of the dumbbell 202 during use.

Figure 14:
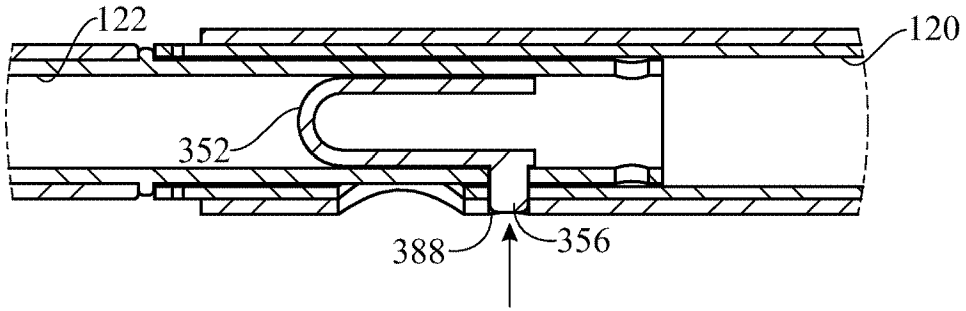
FIG. 14 presents an enlarged area of detail view of FIG. 13 illustrating bar connection components.

As noted hereinabove, the handle assembly 114 may be removed from the housing 112 and, along with one or more of the dumbbells 202 and 204, may be reassembled to form the straight bar 350 for use in different weight lifting exercises. Referring now to FIGS. 12-16, and initially with regard to FIG. 12-14, one end of a fully assembled straight bar 350 is illustrated prior to assembly. The second end 304 of the first end bar 122 is inserted into the center bar 120 until the button 356 of the U-shaped spring clip 352 engages a hole 388 in the center bar 120 to lock the first end bar 122 to the center bar 120 (FIG. 14).

Figure 16:
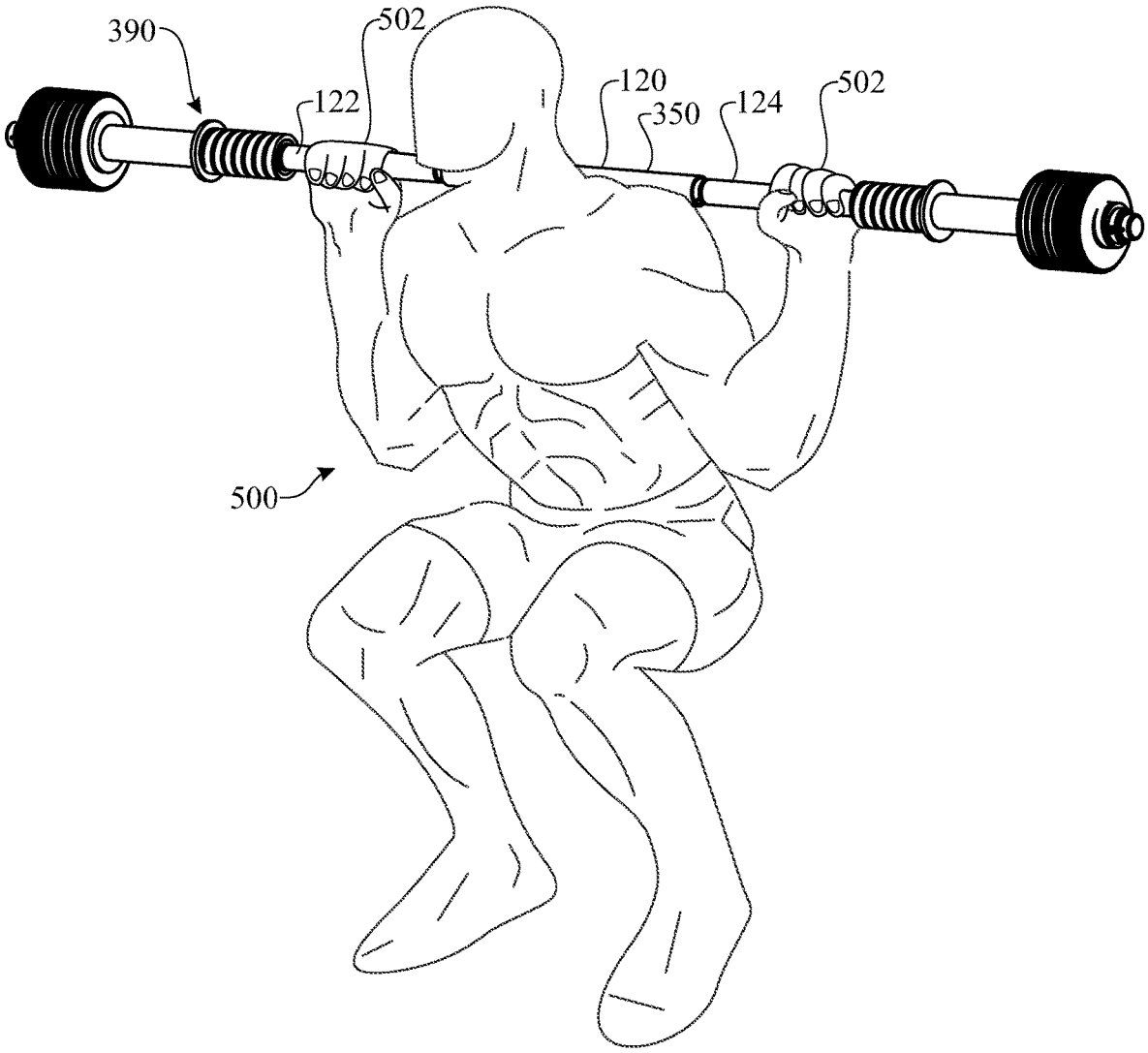
FIG. 16 presents a perspective view of the assembled long bar weight system of the portable weight-based exercise system of FIG. 1 in use to perform an exercise.

The heavyweight and/or lightweight disks 240 and 242 are threaded onto one rotatable handle, such as rotatable handle 222 of the dumbbell 202, in the manner described hereinabove. The first end 252 of the first end bar 122 is slid into the through bore 294 in the dumbbell 202 and the end cap 126 is inserted into the first end 252 to secure the dumbbell 202 to the first end bar 122 in the manner described hereinabove with regard to the engagement of the end cap 126 with the center bar 120. While not specifically shown, the process is repeated with the second end bar 124 and the center bar 120 using the other U-shaped spring clip 354. The dumbbell 204 is then threaded with one or more of the heavyweight and lightweight disks 240 and 242 and the first end 272 (FIG. 3) of the second end bar 124 is inserted into the dumbbell 204 and secured thereon by the end cap 128. This produces a fully assembled long weight bar 390, comprising the aforementioned straight bar 350 and attached disks 240, 242, for use in weight lifting exercises (FIG. 16).

In use, the user 500 can grasp the first and second end bars 122 and 124 and can lift and lower the long weight bar 390 to perform various weight lifting exercises. When the exercise session has been completed, the components are disassembled in reverse order and returned to their respective locations within the housing 112.

Additionally, exercises may be performed with the jump rope 210 and the exercise band 208 to round out the exercise session. If the user 500 desires, the user supplied electronic device 400 may be connected to the charging cable 154 and music or instructional material, contained on the electronic device 400, played back through the speaker 152 (FIG. 1) to enhance the exercise session.

In this manner, the portable weight-based exercise system 100 forms a useful and convenient system for bringing a persons or user 500's exercise routine along with them while travelling.

Referring next to FIGS. 17-26 of the drawings, a portable weight-based exercise system in accordance with a second illustrative embodiment of the present invention is generally indicated by reference numeral 1100. In the portable weight-based system 1100, elements which are analogous to the respective elements of the portable weight-based system 100 that was heretofore described with respect to FIGS. 1-16 are designated by the same respective reference numerals in the 1100-1500 series in FIGS. 17-26. Unless otherwise noted, the elements of the portable weight-based system 1100 may be the same as or similar to those of the portable weight-based system 100.

Figure 18:
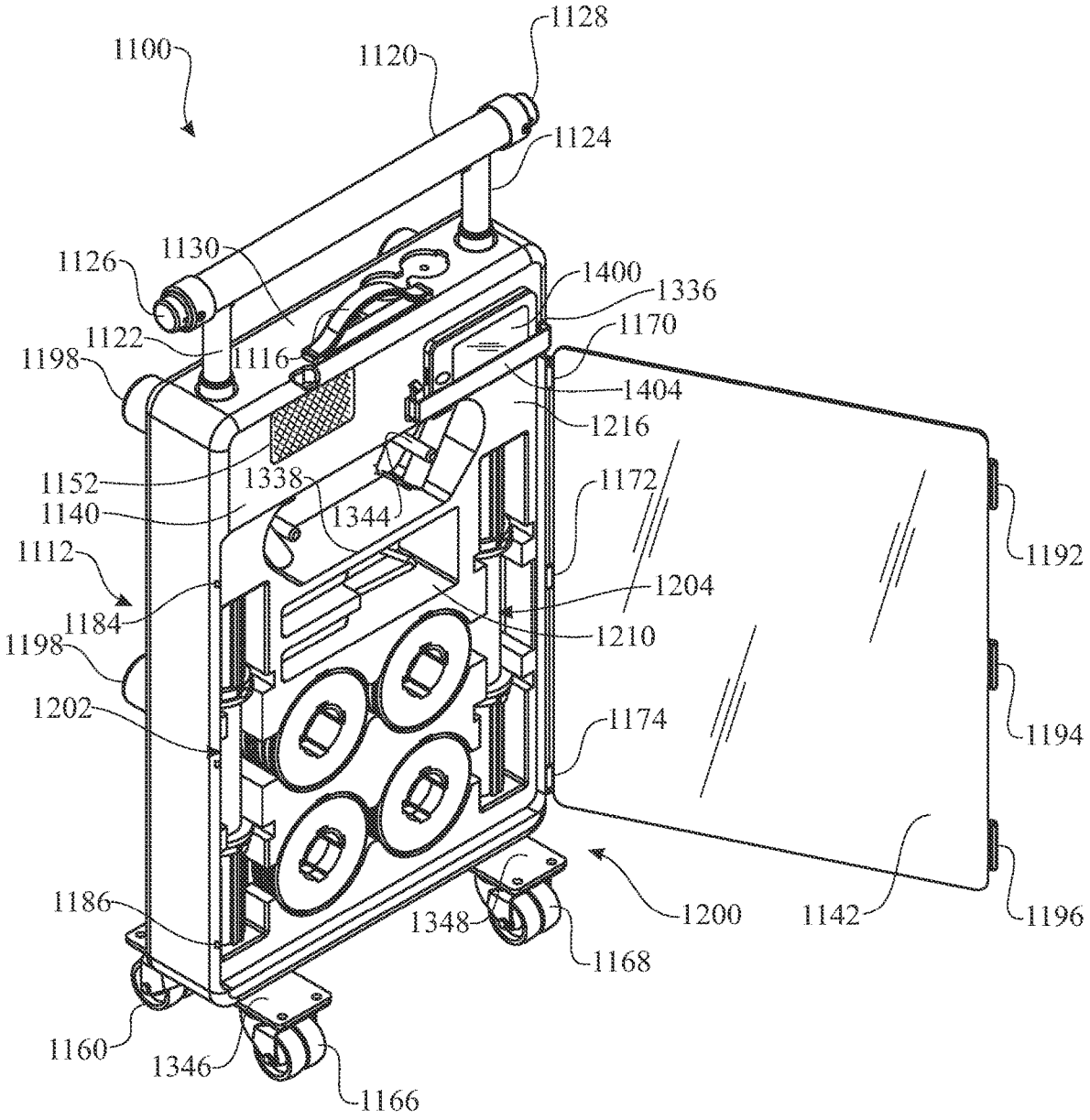
FIG. 18 presents a top front isometric view of the portable weight-based exercise system of FIG. 17 with the movable lower front panel shown open to reveal internal components.
Figure 19:
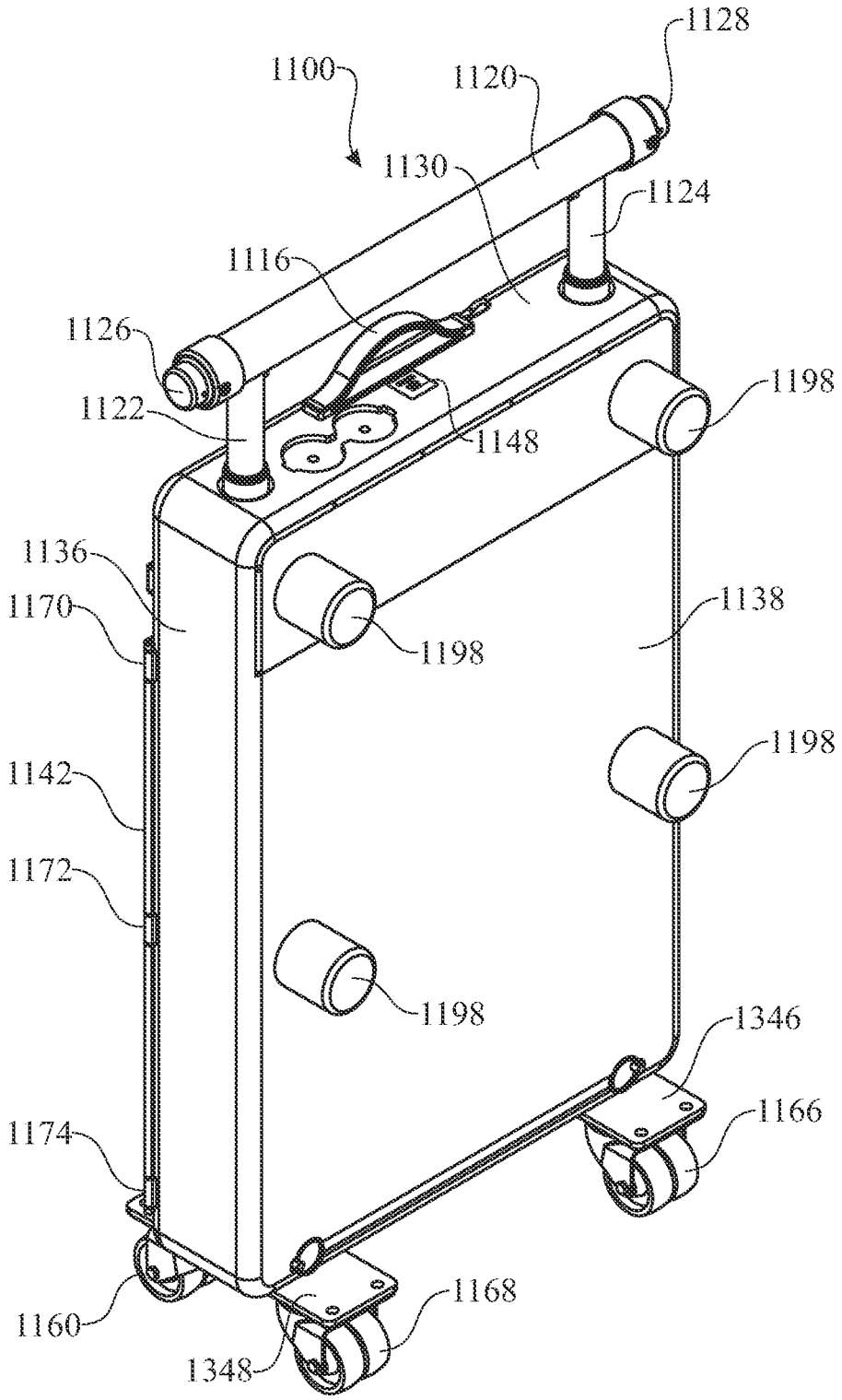
FIG. 19 presents a top rear isometric view of the portable weight-based exercise system of FIG. 17.
Figure 20:
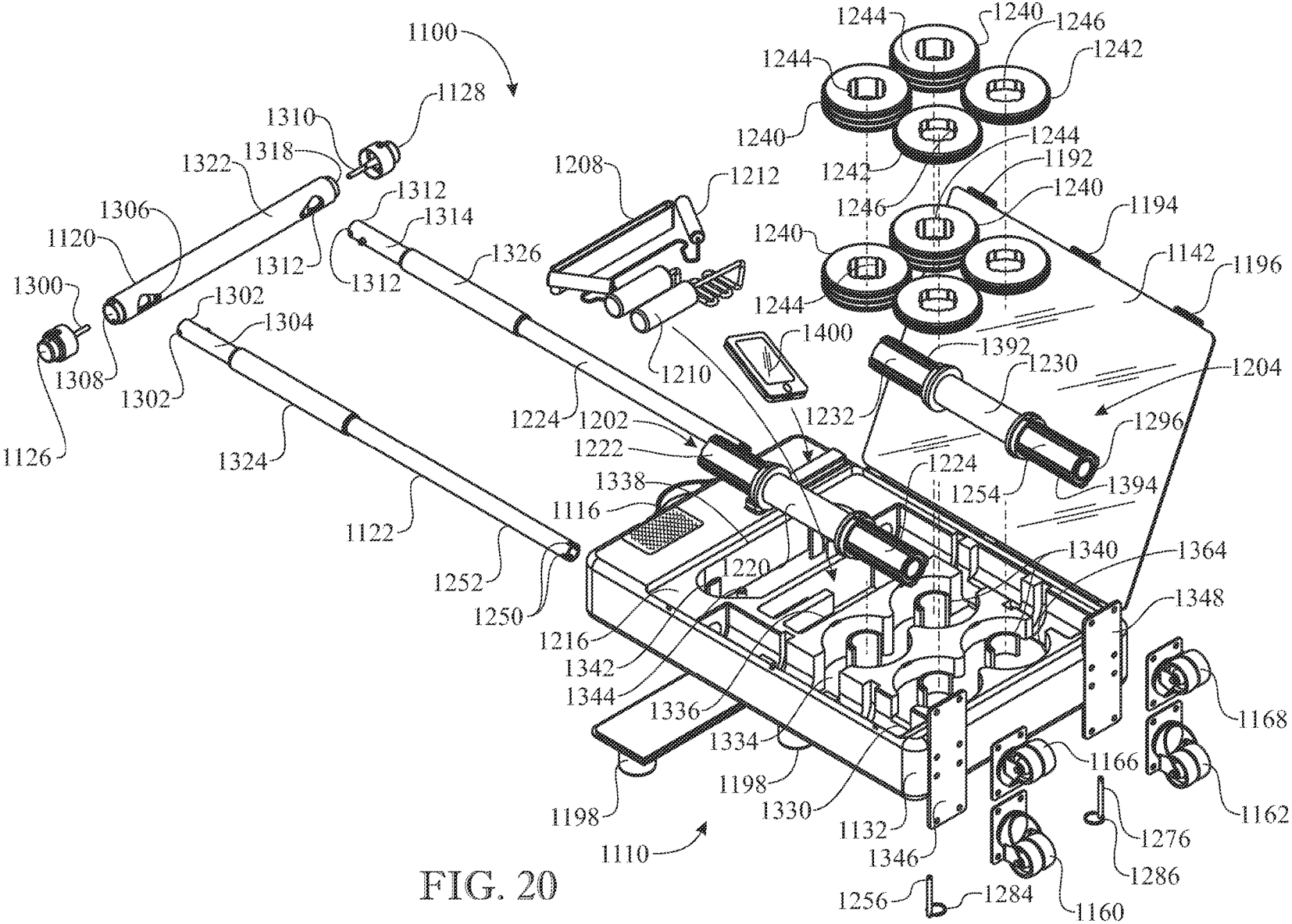
FIG. 20 presents an exploded, isometric view of the portable weight-based exercise system of FIG. 17.
Figure 21:
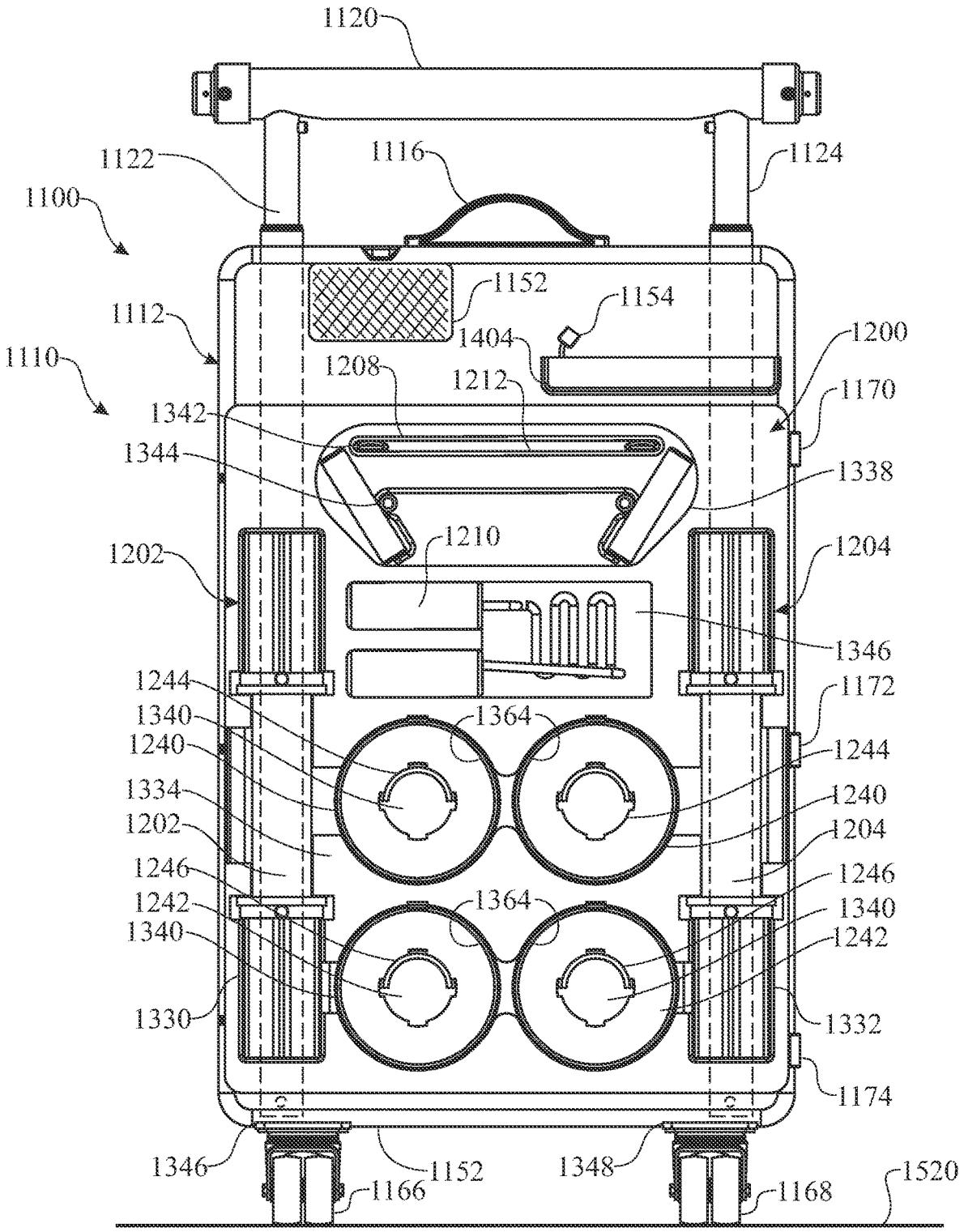
FIG. 21 presents a front elevation view of the portable weight-based exercise system of FIG. 17, with portions of end bars of a handle assembly shown in phantom and extending through respective dumbbells and a carrying case of the portable weight-based exercise system.
Figure 22:
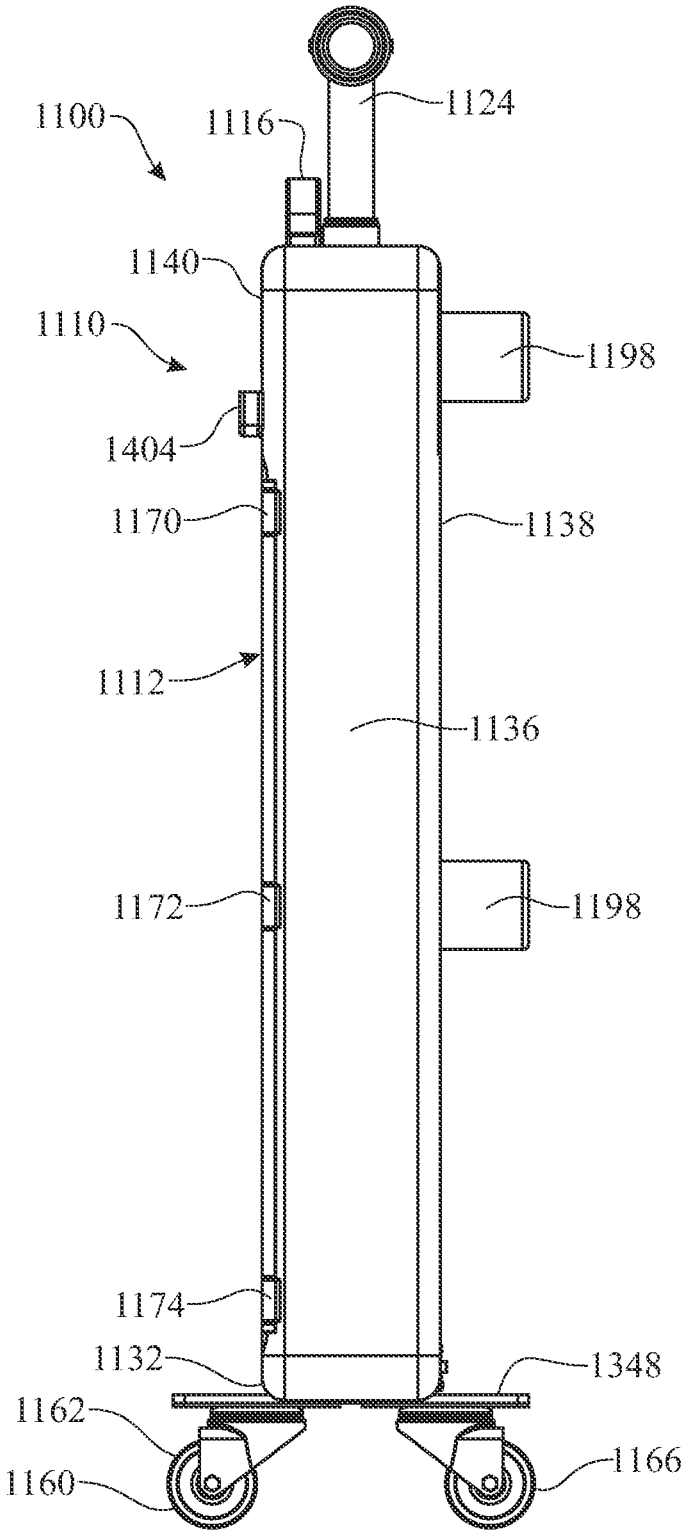
FIG. 22 presents a side elevation view of the portable weight-based exercise system of FIG. 17, shown in an upright rolling position.

As illustrated in FIGS. 18-22, the portable weight-based system 1100 may have a first wheel assembly 1160, a second wheel assembly 1162, a third wheel assembly 1166 and a fourth wheel assembly 1168 on the carrying case 1110. As illustrated in FIG. 20, a first bracket 1346 and a second bracket 1348 may be provided in spaced-apart relationship to each other on the bottom panel 1132 of the housing 1112. The first bracket 1346 and the second bracket 1348 may each extend beyond the back panel 1138 and the movable lower front panel 1142 of the housing 1112. The first wheel assembly 1160 and the third wheel assembly 1166 may be mounted on the first bracket 1346, and the second wheel assembly 1162 and the fourth wheel assembly 1168 may be mounted on the second bracket 1348. Accordingly, as illustrated in FIGS. 21 and 22, the first wheel assembly 1160, the second wheel assembly 1162, the third wheel assembly 1166 and the fourth wheel assembly 1168 may selectively render the portable weight-based system 1100 self-standing on a floor 1520 in typical use thereof.

As illustrated in FIGS. 19 and 22, in some embodiments, a plurality of stand-offs 1198 may extend from the back panel 1138 of the housing 1112. The stand-offs 1198 may support the housing 1112 in applications in which the carrying case 1110 is laid in a horizontal position (not illustrated) on the floor 520 to access the contents of the carrying case 1110.

As illustrated in FIGS. 17-22, in some embodiments, a carrying handle 1116 may be attached to the top panel 1130 of the housing 1112 according to the knowledge of those skilled in the art. In some embodiments, the carrying handle 1116 may include a strap of leather, plastic or other material which is suitable for the purpose.

Figure 17:
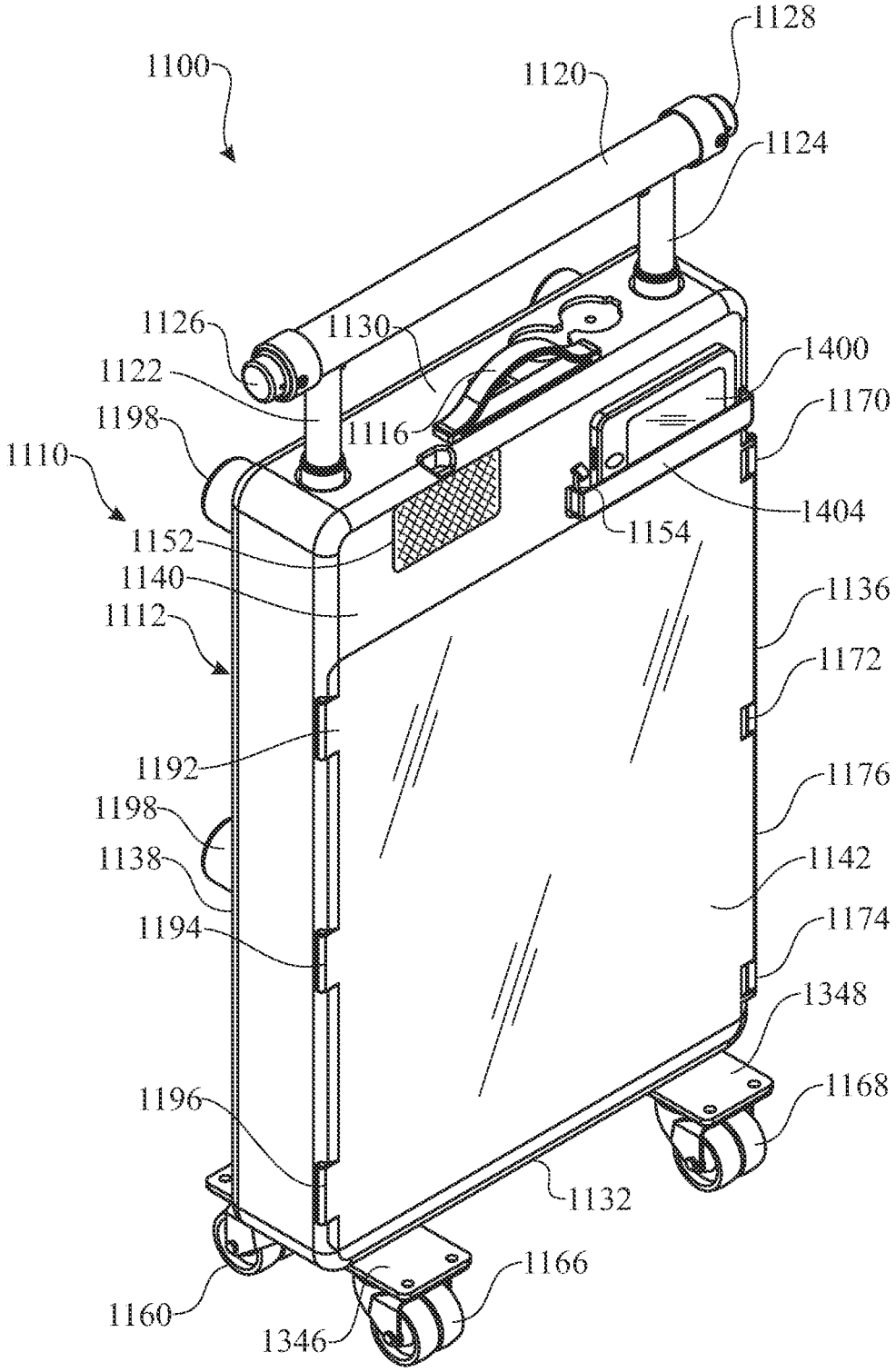
FIG. 17 presents a top front isometric view of a portable weight-based exercise system in accordance with a second illustrative embodiment of the present invention, the movable lower front panel shown closed.

As illustrated in FIGS. 17 and 18, in some embodiments, a device support bracket 1404 may extend from the fixed upper front panel 1140 of the housing 1112. As illustrated in FIGS. 17 and 18, the device support bracket 1404 may be suitably sized and configured to hold or support an electronic device 1400. The charging port/connection cable 1154 for the electronic device 1400 may extend between the fixed upper front panel 1140 and the device support bracket 1404 to facilitate connection of the electronic device 1400 to the charging port/connection cable 1154 for playback of music, verbal exercise routine instructions, etc. through the speaker 1152.

As illustrated in FIGS. 17 and 18, in some embodiments, a plurality of hinges 1170, 1172 and 1174 may pivotally attach the second side edge 1176 of the movable lower front panel 1142 to the second side panel 1136 of the housing 1112. Latches 1192, 1194, 1196 may detachably fasten the movable lower front panel 1142 in the closed position illustrated in FIG. 17. The latches 1192, 1194, 1196 may have any design which is known by those skilled in the art and suitable for detachably engaging the housing 1112 and securing the movable lower front panel 1142 in the closed position.

As illustrated in FIGS. 18, 20 and 21, in some embodiments, the fifth cutout 1338 in the insert 1216 may be suitably sized and configured to accommodate exercise band 1208 and a hand exerciser 1212. Accordingly, the pair of spaced-apart posts 1342 may be provided in the fifth cutout 1338 to accommodate the exercise band 1208 in the stretched configuration for storage. As illustrated in FIG. 21, a pair of spaced-part posts 1344 may additionally be provided in the fifth cutout 1338 to support the hand exerciser 1212 in the storage position. The exercise band 1208 may be selectively detached from the posts 1342 for use of the exercise band 1208, whereas the hand exerciser 1212 can be selectively removed from the posts 1344 for use of the hand exerciser 1212.

Figure 23:
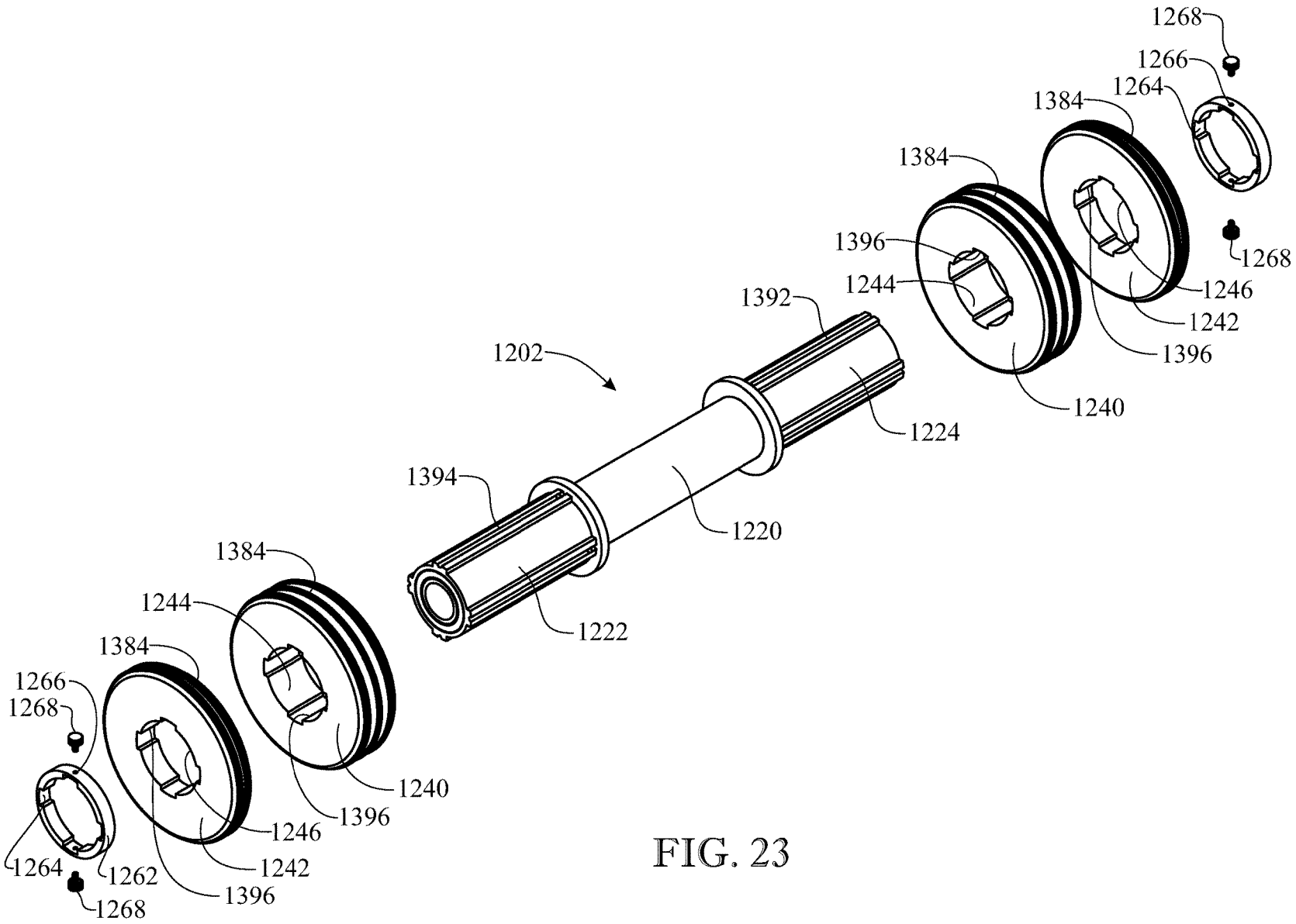
FIG. 23 presents an exploded, isometric view of a dumbbell bar and weights of the portable weight-based exercise system of FIG. 17 prior to assembly.
Figure 24:
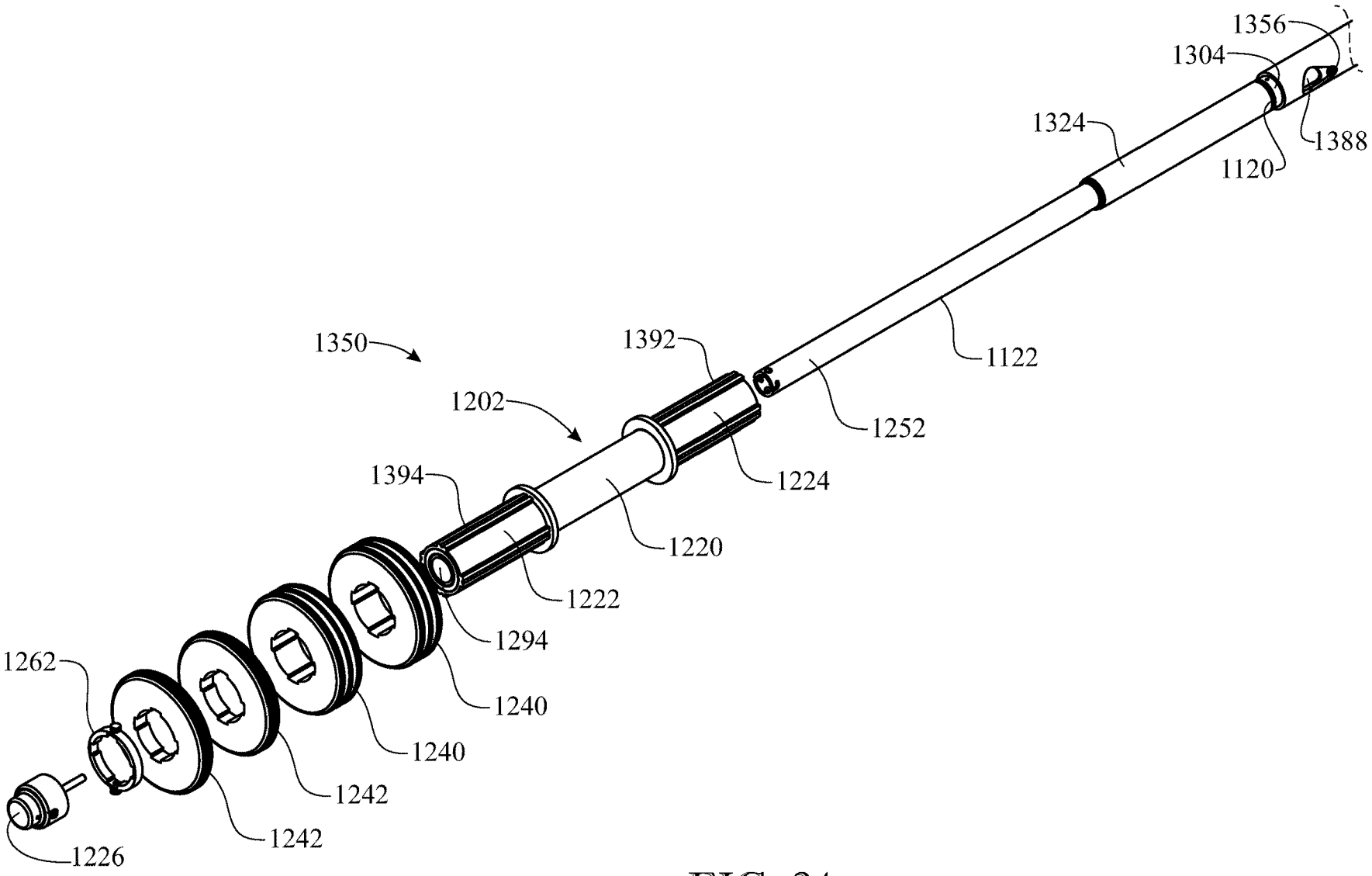
FIG. 24 presents an exploded, partial isometric view of the handle assembly, dumbbell and weights components of the portable weight-based exercise system of FIG. 17 prior to assembly into a long bar weight system.

As illustrated in FIGS. 23 and 24, in some embodiments, at least one handle key 1392, 1394 may be provided on each of the rotatable handle 1222 and the rotatable handle 1124 of the dumbbell 1202. Similarly, as illustrated in FIG. 20, at least one handle key 1392, 1394 may be provided on each of the rotatable handle 1232 and the rotatable handle 1234 of the dumbbell 1204. As illustrated in FIGS. 20, 23 and 24, at least one weight key slot 1396 may be provided in the center hole 1246 of each heavyweight disk 1240 and each lightweight disk 1242. Accordingly, in placement of the heavyweight disk 1240 and/or the lightweight disk 1242 on the corresponding rotatable handle 1222, 1224 of the dumbbell 1202, the weight key slot 1396 may receive the companion handle key 1392, 1394 on the corresponding rotatable handle 1222, 1234 to non-rotationally secure the heavyweight disk 1240 and/or lightweight disk 1242 on the rotatable handle 1222, 1234.

As illustrated in FIGS. 23-26, a weight retaining collar 1262 may be deployed in place on the rotatable handle 1222 and rotatable handle 1224 to prevent the heavyweight disk 1240 and/or lightweight disk 1242 from inadvertently sliding off the rotatable handle 1222, 1234. The weight retaining collar 1262 may have at least one collar key slot 1264 which accommodates the handle key 1392, 1394 on the corresponding rotatable handle 1222, 1224. At least one set screw opening 1266 may extend through the weight retaining collar 1262. A set screw 1268 may be threaded into each set screw opening 1266 and against the corresponding rotatable handle 1222, 1224 to secure the weight retaining collar 1262 on the rotatable handle 1222, 1224 as the weight retaining collar 1262 retains the heavyweight disk 1240 and/or the lightweight disk 1242 thereon. The same description of the weight key slot 1396, weight retaining collar 1262, collar key slot 1264 and set screw opening 1266 may apply with respect to the dumbbell 1204.

Application of the exercise apparatus 1100 may be as was heretofore described with respect to the exercise apparatus 100 in FIGS. 1-16. As illustrated in FIGS. 17-19, 21 and 22, the carrying case 110 may be deployed in an upright position for transport on a floor 520 by placing the first wheel assembly 1160, second wheel assembly 1162, third wheel assembly 1166 and fourth wheel assembly 1168 on the floor 520. The center bar 1120 of the handle assembly 114 may be gripped and pulled to roll the first wheel assembly 1160, second wheel assembly 1162, third wheel assembly 1166 and fourth wheel assembly 1168 on the floor 520. The carrying case 110 may be lifted and carried by grasping the carrying handle 1116.

The carrying case 110 may be selectively laid in a horizontal position on the floor 520 by tilting the carrying case 110 on the first wheel assembly 1160 and second wheel assembly 1162 until the stand-offs 1198 rest and support the carrying case 1110 on the floor 520. Accordingly, the stand-offs 1198 may support the carrying case 1110 in a level position on the floor 520 to facilitate opening of the movable lower front panel 1142 about the hinges 1170, 1172, 1174 after unlatching of the latches 1192, 1194, 1196.

As illustrated in FIG. 20, the exercise band 1208 and/or the hand exerciser 1212 may be selectively removed from the fifth cutout 1338 for use. Similarly, the jump rope 1210 may be selectively removed from the fourth cutout 1336 for use. In some applications, the electronic device 1400 may be placed in the device support bracket 1404 and connected to the charging port/connection cable 1154 for playback of music, verbal exercise routine instructions, etc. through the speaker 1152.

In some applications, the exercise components 1200 of one or both of the dumbbells 1202, 1204 may be removed from the first cutout 1330, second cutout 1332 and sixth cutouts 1364 of the insert 1216, as illustrated in FIG. 20, and assembled for use. As illustrated in FIG. 23, the dumbbell 1202 may be assembled by placing one or more of the heavyweight disks 1240 and/or one or more of the lightweight disks 1242 on each rotatable handle 1222, 1224. This may be accomplished by aligning the weight key slot 1396 in each heavyweight disk 1240 and/or each lightweight disk 1242 with the companion handle key 1392 on the rotatable handle 1224 or the companion handle key 1394 on the rotatable handle 1222, and then sliding the heavyweight disk or disks 1240 and/or lightweight disk or disks 1242 on the corresponding rotatable handle 1222 or 1224. Each weight retaining collar 1262 may be placed on each corresponding rotatable handle 1222, 1224 by aligning the collar key slot 1264 with the corresponding handle key 1392 on the rotatable handle 1224 or handle key 1394 on the rotatable handle 1222 and sliding the weight retaining collar 1262 on the rotatable handle 1222, 1224. The set screw 1268 may be threaded into the corresponding set screw opening 1266 in the weight retaining collar 1262 and tightened against the corresponding rotatable handle 1222, 1224. The dumbbell 1204 may be assembled in like manner. Accordingly, the dumbbells 1202, 1204 may be used in the same manner as was heretofore described with respect to use of the dumbbells 202, 204 in FIGS. 10 and 11. After use, the dumbbells 1202, 1204 may be disassembled by reversing the steps outlined above and replaced in the insert 1216 in the carrying case 1110.

Figure 25:
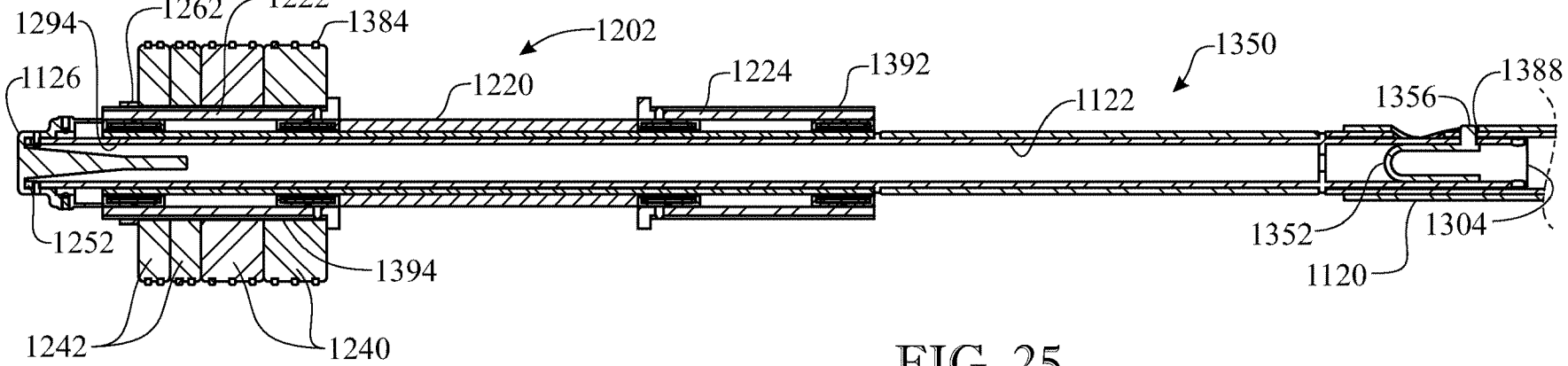
FIG. 25 presents a partial, cross-sectional front elevation view of the long bar weight system of the portable weight-based exercise system of FIG. 17.
Figure 26:
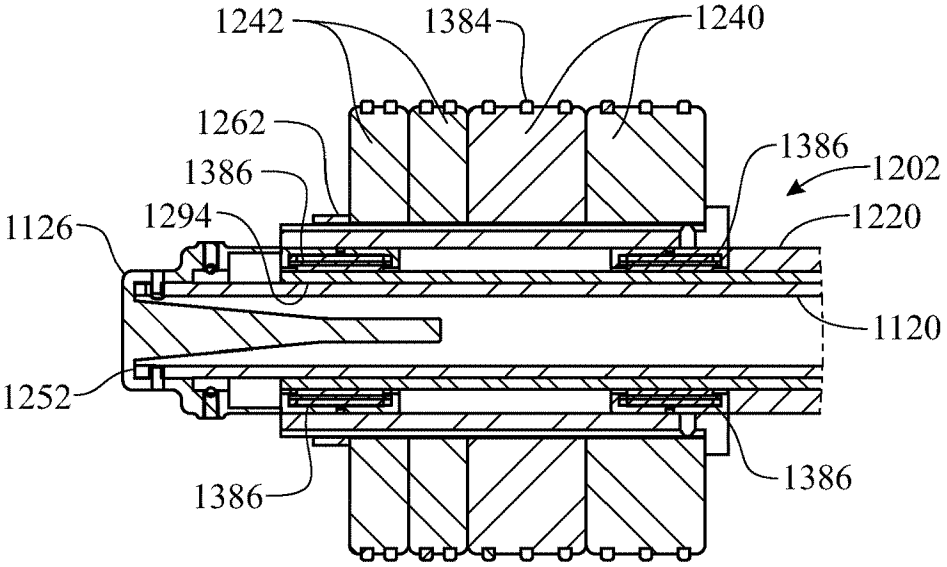
FIG. 26 presents an additional enlarged area of detail view of FIG. 25 illustrating weight assembly components and a bearing system of the dumbbell bar.

As illustrated in FIGS. 24-26, in some applications, a single straight bar 1350 may be assembled for use as a barbell by inserting the second end 1304 of the first end bar 1122 into the center bar 1120 until the button 1356 of the U-shaped spring clip 1352 engages a hole 1388 in the center bar 1120 to lock the first end bar 1122 to the center bar 1120. The heavyweight and/or lightweight disks 1240 and 1242, respectively, may be placed onto the extending rotatable handle 1222 of the dumbbell 1202, in the manner described hereinabove. The first end 1252 of the first end bar 1122 may be slid into the through bore 1294 in the dumbbell 1202 and the end cap 1126 may be inserted into the first end 1252 to secure the dumbbell 1202 to the first end bar 1122 in the manner described hereinabove with regard to the engagement of the end cap 126 with the center bar 120 of the weight-based exercise system 100. The procedure may be repeated with the second end bar 1124 and the center bar 1120 using the other U-shaped spring clip 1354. The dumbbell 1204 may then be threaded with one or more of the heavyweight and lightweight disks 1240 and 1242 and the first end 1272 of the second end bar 1124 is inserted into the dumbbell 1204 and secured thereon by the end cap 1128. This produces the fully assembled long weight bar 1390, comprising the aforementioned straight bar 1350 and attached disks 1240, 1242, for use in weight lifting exercises (FIG. 16).

In use, the user 500 can grasp the first and second end bars 1122 and 1124 and lift and lower the long weight bar 1390 to perform various weight lifting exercises. When the exercise session has been completed, the components may be disassembled in reverse order and returned to their respective locations within the housing 1112.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A portable weight-based exercise system, comprising:
a carrying case including:
a housing, and
a handle assembly comprising a center bar and first and second end bars, the handle assembly configured to selectively and reversibly adopt a mounted configuration in which first ends of said first and second end bars are removably mounted within said housing and second ends of said first and second end bars are removably connected to said center bar, and further in which the center bar provides a gripping area to assist a user in transporting the portable weight-based exercise system, and an exercising configuration in which the handle assembly is detached from the housing and usable as a lifting weight; and
a plurality of weight training components removably mounted within said housing.

2. The portable weight-based exercise system of claim 1, wherein, when the handle assembly is in the exercising configuration, the first and second end bars are removably mounted to the center bar coaxially with the center bar.

3. The portable weight-based exercise system of claim 2, wherein the plurality of weight training components comprises first and second dumbbells each carrying a respective at least one weight disk, and the first and second dumbbells are removably mounted to the first and second end bars when the handle assembly is in the exercising configuration.

4. The portable weight-based exercise system of claim 3, wherein the first and second dumbbells are removably mounted to the first and second end bars when the handle assembly is in the exercising configuration such that the first and second dumbbells, first and second end bars and center bar are coaxially arranged forming a straight bar.

5. The portable weight-based exercise system of claim 4, wherein, in the exercising configuration of the handle assembly, the first dumbbell and a first end of the center bar are mounted to the first and second ends of the first end bar, and the second dumbbell and a second end of the center bar, opposite to the first end of the center bar, are mounted to the first and second ends of the second end bar, and the respective at least one weight disk is removably carried by each one of the first and second dumbbells.

6. The portable weight-based exercise system of claim 2, further comprising a pair of U-shaped spring clips securing the first and second end bars to the center bar in the exercising configuration of the handle assembly.

7. The portable weight-based exercise system of claim 1, further comprising at least one insert in said housing, and wherein said plurality of weight training components is removably placed in said at least one insert.

8. The portable weight-based exercise system of claim 1, further comprising at least one movable panel on the housing to facilitate access to the plurality of weight components within the housing.

9. The portable weight-based exercise system of claim 1, further comprising a charging port for charging and connecting an electronic device, and a speaker carried by the housing for playing back electronic audio files from the electronic device.

10. The portable weight-based exercise system of claim 1, wherein the plurality of weight training components comprises at least one of a jump rope, an exercise band and a hand exerciser.

11. The portable weight-based exercise system of claim 1, further comprising at least one wheel assembly carried by and providing rolling mobility to said housing.

12. The portable weight-based exercise system of claim 1, further comprising a plurality of stand-offs carried by said housing and configured to support the housing on a floor or other flat surface such that the housing is elevated from the floor or other flat surface.

13. The portable weight-based exercise system of claim 1, wherein the plurality of weight training components comprises at least one dumbbell having at least one weight disk.

14. The portable weight-based exercise system of claim 13, wherein the at least one weight disk comprises at least one heavyweight disk and at least one lightweight disk.

15. The portable weight-based exercise system of claim 14, wherein each of the at least one heavyweight disk and the at least one lightweight disk is removably mountable on the at least one dumbbell.

16. The portable weight-based exercise system of claim 13, wherein at least one of the first and second end bars extend through a through bore formed through a central shaft of the at least one dumbbell when the handle assembly is arranged in the mounted configuration.

17. The portable weight-based exercise system of claim 13, wherein the at least one dumbbell comprises first and second dumbbells.

18. The portable weight-based exercise system of claim 1, wherein the first and second end bars extend perpendicularly from the center bar when the handle assembly is arranged in the mounted configuration.

19. A portable weight-based exercise system, comprising:

a carrying case including:

a housing, and a handle assembly comprising a center bar and first and second end bars, the handle assembly configured to selectively and reversibly adopt a mounted configuration in which first ends of said first and second end bars are removably mounted within said housing and second ends of said first and second end bars are removably connected to said center bar, and further in which the center bar provides a gripping area to assist a user in transporting the portable weight-based exercise system, and an exercising configuration in which the handle assembly is detached from the housing and usable as a lifting weight, with the first and second end bars removably mounted to the center bar coaxially with the center bar; and a plurality of weight training components removably mounted within said housing.

20. A portable weight-based exercise system, comprising:

a carrying case including:

a housing, and a handle assembly comprising a center bar and first and second end bars; and a plurality of weight training components removably mounted within said housing, the plurality of weight training components comprising first and second dumbbells, each of the first and second dumbbells comprising a dumbbell shaft and at least one weight disk attachable to the dumbbell shaft; wherein the portable weight-based exercise system is configured to selectively and reversibly adopt:

a mounted configuration in which first ends of said first and second end bars are removably mounted within said housing and second ends of said first and second end bars are removably connected to said center bar, and further in which the center bar provides a gripping area to assist a user in transporting the portable weight-based exercise system, and an exercising configuration in which the handle assembly is detached from the housing and usable as a lifting weight, with the first and second end bars removably mounted to the center bar, the dumbbell shaft of the first dumbbell removably mounted to an outer end of the first end bar and the dumbbell shaft of the second dumbbell removably mounted to an opposite, outer end of the second end bar, such that the first and second dumbbells, first and second end bars and center bar are coaxially arranged forming a straight bar, and further in which at least one weight disk is removably carried by the dumbbell shaft of each one of the first and second dumbbells.

* * * * *